US011482181B2

(12) United States Patent
An et al.

(10) Patent No.: US 11,482,181 B2
(45) Date of Patent: Oct. 25, 2022

(54) DISPLAY DEVICE, AND METHOD OF OPERATING A DISPLAY DEVICE

(71) Applicant: Samsung Display Co., Ltd., Yongin-si (KR)

(72) Inventors: Bo Young An, Hwaseong-si (KR); Kyung Man Kim, Suwon-si (KR); Wook Lee, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/230,819

(22) Filed: Apr. 14, 2021

(65) Prior Publication Data

US 2021/0327367 A1 Oct. 21, 2021

(30) Foreign Application Priority Data

Apr. 16, 2020 (KR) ..... 10-2020-0045747

(51) Int. Cl.
*G09G 3/3291* (2016.01)
*G09G 3/3233* (2016.01)
*G09G 3/20* (2006.01)

(52) U.S. Cl.
CPC ..... *G09G 3/3291* (2013.01); *G09G 3/2003* (2013.01); *G09G 3/3233* (2013.01); *G09G 2300/0842* (2013.01); *G09G 2320/029* (2013.01); *G09G 2320/0233* (2013.01); *G09G 2320/045* (2013.01); *G09G 2320/0626* (2013.01); *G09G 2330/10* (2013.01); *G09G 2330/12* (2013.01); *G09G 2360/16* (2013.01)

(58) Field of Classification Search
CPC .. G09G 3/3291; G09G 3/2003; G09G 3/3233; G09G 2300/0842; G09G 2320/0233; G09G 2320/029; G09G 2320/045; G09G 2320/0626; G09G 2330/10; G09G 2330/12; G09G 2360/16
See application file for complete search history.

(56) References Cited

U.S. PATENT DOCUMENTS

2018/0061320 A1* 3/2018 Kim ..... H01L 51/50
2019/0164486 A1* 5/2019 An ..... G09G 3/3233

FOREIGN PATENT DOCUMENTS

KR 10-1348753 B1 1/2014

* cited by examiner

*Primary Examiner* — Kenneth B Lee, Jr.
(74) *Attorney, Agent, or Firm* — Lewis Roca Rothgerber Christie LLP

(57) ABSTRACT

A display device includes: a display panel including a plurality of pixels; a sensing data memory configured to store sensing data for threshold voltages of driving transistors of the plurality of pixels; a controller configured to determine a total threshold voltage shift amount for the driving transistors of the plurality of pixels based on the sensing data, to determine total luminance data based on input image data, to determine a frame stress based on the total luminance data and the total threshold voltage shift amount, to determine a target compensation voltage level based on the frame stress, and to generate compensated image data by compensating the input image data based on the target compensation voltage level; and a data driver configured to provide data voltages to the plurality of pixels based on the compensated image data.

20 Claims, 16 Drawing Sheets

DISPLAY DEVICE, AND METHOD OF OPERATING A DISPLAY DEVICE

CROSS-REFERENCE TO RELATED APPLICATION

The present application claims priority to and the benefit of Korean Patent Application No. 10-2020-0045747, filed on Apr. 16, 2020 in the Korean Intellectual Property Office (KIPO), the entire content of which is incorporated herein by reference.

BACKGROUND

1. Field

Aspects of some example embodiments of the present inventive concept relate to a display device.

2. Description of the Related Art

Even when a plurality of pixels included in a display device, such as an organic light emitting diode (OLED) display device, are manufactured as part of the same manufacturing process, driving transistors of the plurality of pixels may have different driving characteristics due to variations in the manufacturing process, or the like. Thus the plurality of pixels may emit light with different luminances. Further, as the OLED display device operates over time, the plurality of pixels may be degraded, and the driving characteristics of the driving transistors may be degraded over time. To compensate for the non-uniformity of luminance between pixels and for the degradation of pixels, the OLED display device may perform a sensing operation that senses the driving characteristics (e.g., threshold voltages and/or mobility) of the driving transistors of the plurality of pixels. The OLED display device may display an image with relatively uniform luminance by compensating image data based on sensing data generated by the sensing operation.

The above information disclosed in this Background section is only for enhancement of understanding of the background and therefore the information discussed in this Background section does not necessarily constitute prior art.

SUMMARY

Aspects of some example embodiments of the present inventive concept relate to a display device, and for example, to a display device that compensates image data based on sensing data, and a method of operating the display device.

Aspects of some example embodiments include a display device that may be capable of improving degradation characteristics and reducing power consumption.

Aspects of some example embodiments include a method of operating a display device that may be capable of improving degradation characteristics and reducing power consumption.

According to some example embodiments, a display device includes a display panel including a plurality of pixels, a sensing data memory configured to store sensing data for threshold voltages of driving transistors of the plurality of pixels, a controller configured to determine a total threshold voltage shift amount for the driving transistors of the plurality of pixels based on the sensing data, to determine total luminance data based on input image data, to determine a frame stress based on the total luminance data and the total threshold voltage shift amount, to determine a target compensation voltage level based on the frame stress, and to generate compensated image data by compensating the input image data based on the target compensation voltage level, and a data driver configured to provide data voltages to the plurality of pixels based on the compensated image data.

According to some example embodiments, the controller may determine the target compensation voltage level such that the target compensation voltage level increases as the frame stress increases.

According to some example embodiments, the controller may compare the frame stress with a reference stress, may determine the target compensation voltage level as a default compensation voltage level when the frame stress is less than or equal to the reference stress, and may increase the target compensation voltage level in linearly proportional to the frame stress as the frame stress increases when the frame stress is greater than the reference stress.

According to some example embodiments, the controller may compare the frame stress with a reference stress, may determine the target compensation voltage level as a default compensation voltage level when the frame stress is less than or equal to the reference stress, and may increase the target compensation voltage level by using an N-th order equation of the frame stress as the frame stress increases when the frame stress is greater than the reference stress, where N is an integer greater than 1.

According to some example embodiments, the controller may generate a plurality of pixel compensation data based on differences between the target compensation voltage level and a plurality of threshold voltage levels corresponding to a plurality of threshold voltage data included in the sensing data, and may generate the compensated image data by adding the plurality of pixel compensation data to the input image data.

According to some example embodiments, each of the plurality of pixels may include a switching transistor configured to transfer the data voltage of a data line in response to a scan signal, a storage capacitor configured to store the data voltage transferred by the switching transistor, the driving transistor configured to generate a driving current based on the data voltage stored in the storage capacitor, an organic light emitting diode configured to emit light based on the driving current generated by the driving transistor, and a sensing transistor configured to connect a node between the driving transistor and the organic light emitting diode to a sensing line in response to a sensing signal.

According to some example embodiments, the display device may further include a sensing circuit coupled to a plurality of sensing lines. In a sensing period, the data driver may provide a reference voltage to the plurality of pixels through a plurality of data lines. In the sensing period, the sensing circuit may receive a plurality of sensing voltages from the plurality of pixels through the plurality of sensing lines, and may generate the sensing data corresponding to differences between the reference voltage and the plurality of sensing voltages. The controller may receive the sensing data from the sensing circuit, and may write the sensing data to the sensing data memory.

According to some example embodiments, the controller may include a threshold voltage shift calculating block configured to calculate current total threshold voltage data by summing a plurality of threshold voltage data included in the sensing data, and to calculate the total threshold voltage shift amount by subtracting initial total threshold voltage data before the plurality of pixels is degraded from the current total threshold voltage data, a frame stress calculating block configured to calculate the total luminance data by summing a plurality of pixel data included in the input image data, and to calculate the frame stress by summing the total threshold voltage shift amount and the total luminance data, a compensation target determining block configured to determine the target compensation voltage level based on the frame stress, and a data compensation block configured to generate a plurality of pixel compensation data based on differences between the target compensation voltage level and a plurality of threshold voltage levels corresponding to the plurality of threshold voltage data, and to generate the compensated image data by adding the plurality of pixel compensation data to the input image data.

According to some example embodiments, the compensation target determining block may store M frame stresses in M frame periods, where M is an integer greater than 0, may calculate an average of the M frame stresses, and may determine the target compensation voltage level according to the average of the M frame stresses.

According to some example embodiments, in a case where the frame stress is changed from a first frame stress to a second frame stress, the compensation target determining block may gradually change the target compensation voltage level from a first target compensation voltage level corresponding to the first frame stress to a second target compensation voltage level corresponding to the second frame stress for a transition time corresponding to a plurality of frame periods.

According to some example embodiments, the compensation target determining block may receive a dimming signal representing a dimming level, and may determine the target compensation voltage level based on the frame stress and the dimming signal such that the target compensation voltage level increases as the frame stress increases and the target compensation voltage level increases as the dimming level increases.

According to some example embodiments, the plurality of pixels may include red pixels, green pixels and blue pixels. The controller may determine, as the total threshold voltage shift amount, a red total threshold voltage shift amount for the red pixels, a green total threshold voltage shift amount for the green pixels, and a blue total threshold voltage shift amount for the blue pixels, may determine, as the total luminance data, red total luminance data for the red pixels, green total luminance data for the green pixels, and blue total luminance data for the blue pixels, may determine, as the frame stress, a red frame stress based on the red total luminance data and the red total threshold voltage shift amount, a green frame stress based on the green total luminance data and the green total threshold voltage shift amount, and a blue frame stress based on the blue total luminance data and the blue total threshold voltage shift amount, may determine, as the target compensation voltage level, a red target compensation voltage level corresponding to the red frame stress, a green target compensation voltage level corresponding to the green frame stress, and a blue target compensation voltage level corresponding to the blue frame stress, and may generate the compensated image data by compensating the input image data based on the red target compensation voltage level, the green target compensation voltage level and the blue target compensation voltage level.

According to some example embodiments, the display panel may be divided into a plurality of pixel blocks. The controller may determine, as the target compensation voltage level, a plurality of block target compensation voltage levels for the plurality of pixel blocks, and may generate the compensated image data by compensating the input image data based on the plurality of block target compensation voltage levels.

According to some example embodiments, in a case where the input image data are black image data representing a 0-gray level, the controller may generate the compensated image data representing a negative gray level based on the target compensation voltage level that is a positive voltage level, and the data driver may provide the data voltages corresponding to the compensated image data representing the negative gray level to the plurality of pixels such that the threshold voltages of the driving transistors are shifted in a negative direction.

According to some example embodiments, in a method of operating a display device including a plurality of pixels, the method includes: sensing data for threshold voltages of driving transistors of the plurality of pixels are stored, a total threshold voltage shift amount for the driving transistors of the plurality of pixels is determined based on the sensing data, total luminance data are determined based on input image data, a frame stress is determined based on the total luminance data and the total threshold voltage shift amount, a target compensation voltage level is determined based on the frame stress, compensated image data are generated by compensating the input image data based on the target compensation voltage level, and data voltages are provided to the plurality of pixels based on the compensated image data.

According to some example embodiments, to determine the target compensation voltage level, the target compensation voltage level may be increased as the frame stress increases.

According to some example embodiments, to determine the target compensation voltage level, the frame stress may be compared with a reference stress, the target compensation voltage level may be determined as a default compensation voltage level when the frame stress is less than or equal to the reference stress, and the target compensation voltage level may be increased in linearly proportional to the frame stress as the frame stress increases when the frame stress is greater than the reference stress.

According to some example embodiments, to determine the target compensation voltage level, M frame stresses in M frame periods may be stored, where M is an integer greater than 0, an average of the M frame stresses may be calculated, and the target compensation voltage level may be determined according to the average of the M frame stresses.

According to some example embodiments, to determine the target compensation voltage level, in a case where the frame stress is changed from a first frame stress to a second frame stress, the target compensation voltage level may be gradually changed from a first target compensation voltage level corresponding to the first frame stress to a second target compensation voltage level corresponding to the second frame stress for a transition time corresponding to a plurality of frame periods.

According to some example embodiments, to determine the target compensation voltage level, a dimming signal representing a dimming level may be received, and the target compensation voltage level may be determined based on the frame stress and the dimming signal. The target compensation voltage level may increase as the frame stress increases, and may increase as the dimming level increases.

As described above, in a display device and a method of operating the display device according to some example embodiments, a total threshold voltage shift amount for driving transistors of a plurality of pixels may be determined based on sensing data, total luminance data may be calculated based on input image data, a frame stress may be determined based on the total luminance data and the total threshold voltage shift amount, a target compensation voltage level may be determined based on the frame stress, and compensated image data may be generated by compensating the input image data based on the target compensation voltage level. Accordingly, power consumption of the display device may be reduced, a degradation characteristic may be improved, and a minute dimming mode may be implemented.

BRIEF DESCRIPTION OF THE DRAWINGS

Illustrative, non-limiting example embodiments will be more clearly understood from the following detailed description in conjunction with the accompanying drawings.

DETAILED DESCRIPTION

Hereinafter, embodiments of the present inventive concept will be explained in more detail with reference to the accompanying drawings.

Figure 1:
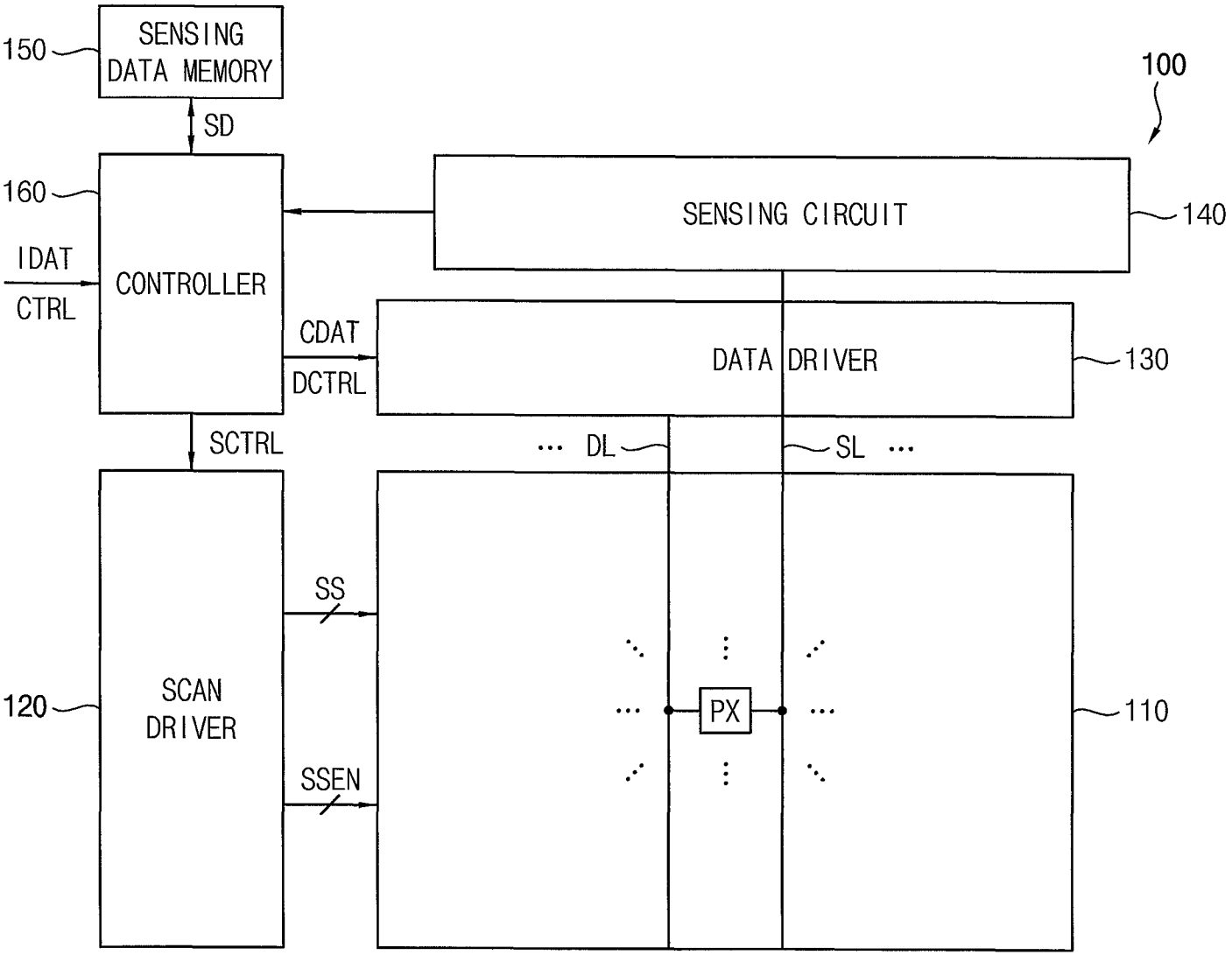
FIG. 1 is a block diagram illustrating a display device according to some example embodiments.
Figure 2:
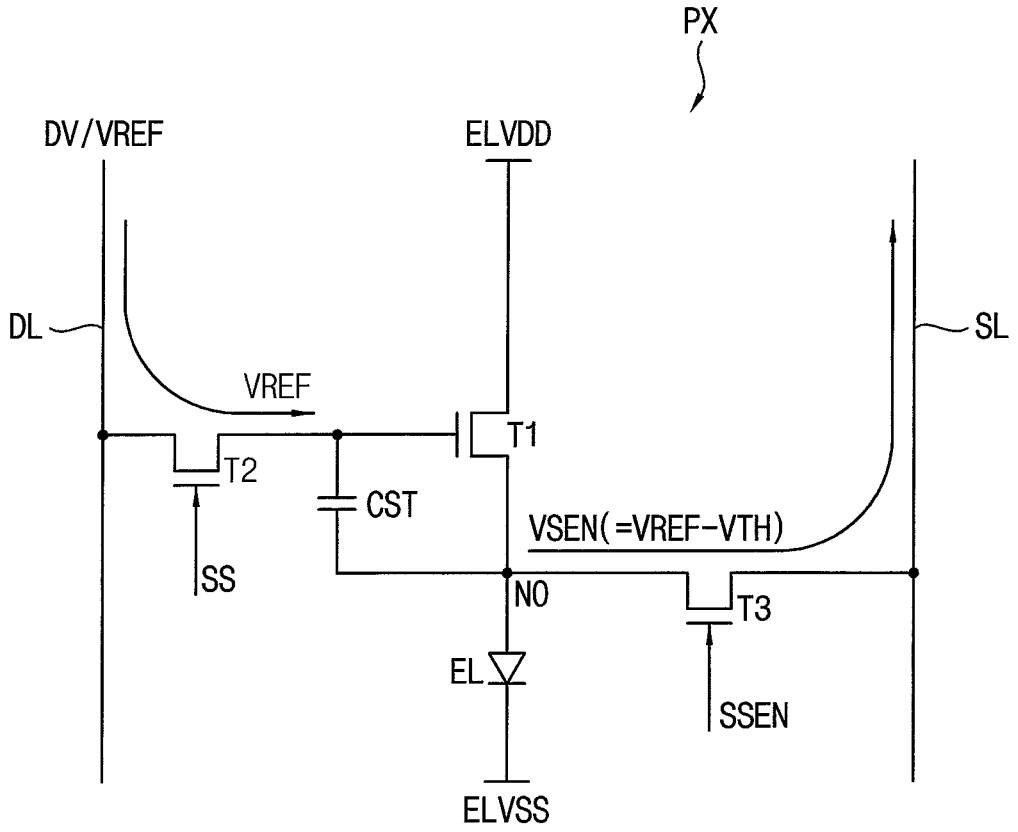
FIG. 2 is a circuit diagram illustrating an example of a pixel included in a display device according to some example embodiments.
Figure 3:
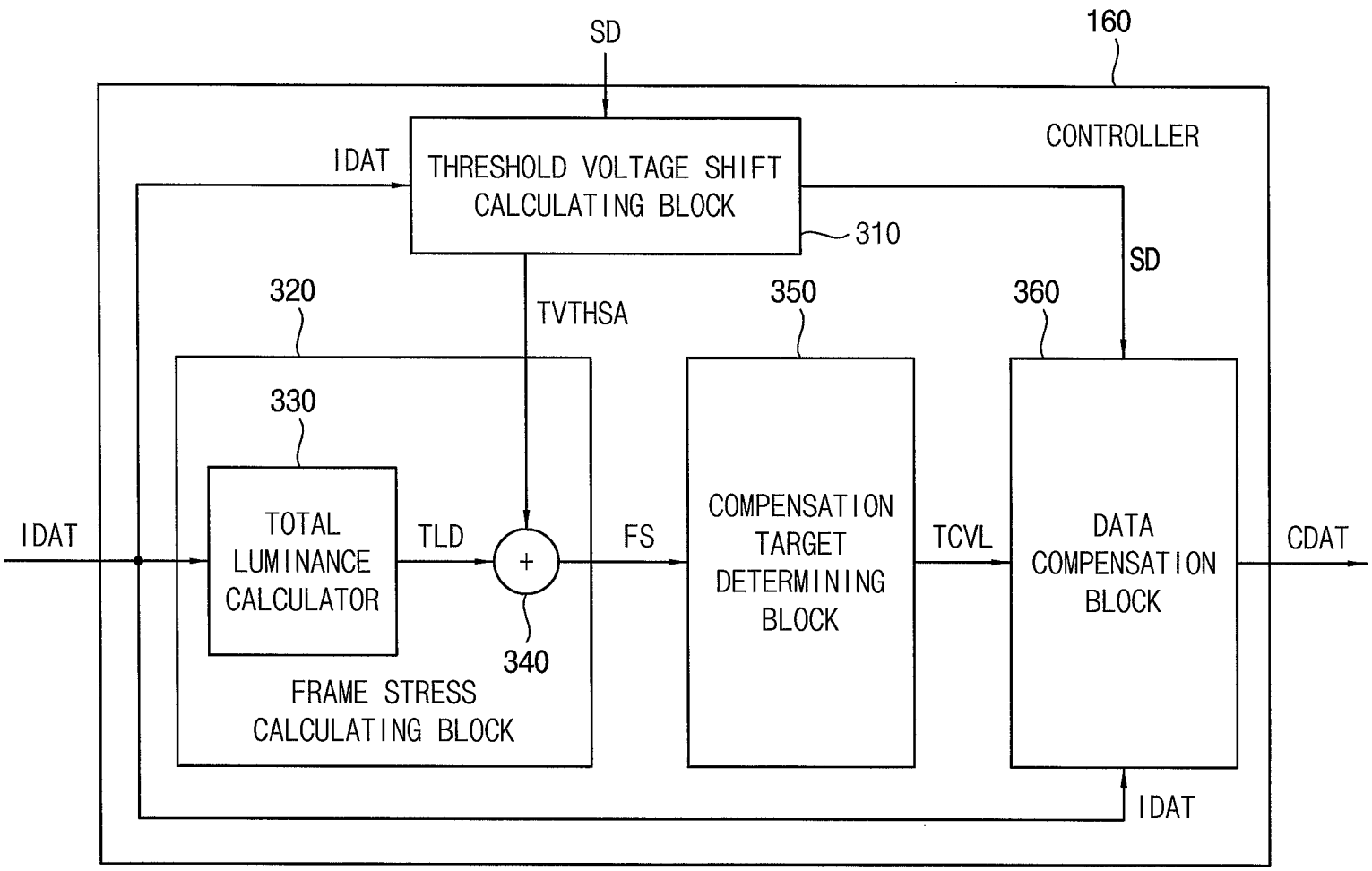
FIG. 3 is a block diagram illustrating a controller included in a display device according to some example embodiments.

FIG. 1 is a block diagram illustrating a display device according to some example embodiments, FIG. 2 is a circuit diagram illustrating an example of a pixel included in a display device according to some example embodiments, and FIG. 3 is a block diagram illustrating a controller included in a display device according to some example embodiments.

Referring to FIG. 1, a display device 100 according to some example embodiments may include a display panel 110, a scan driver 120, a data driver 130, a sensing circuit 140, a sensing data memory 150 and a controller 160.

The display panel 110 may include a plurality of data lines DL, a plurality of sensing lines SL, and a plurality of pixels PX coupled to the plurality of data lines DL and the plurality of sensing lines SL. According to some example embodiments, the number of the plurality of sensing lines SL may be substantially the same as the number of the plurality of data lines DL. According to some example embodiments, the number of the plurality of sensing lines SL may be different from the number of the plurality of data lines DL. For example, the display panel 110 may include one sensing line SL per three data lines DL. According to some example embodiments, each pixel PX may include an organic light emitting diode (OLED), and the display panel 110 may be an OLED panel.

For example, as illustrated in FIG. 2, each pixel PX may include a switching transistor T2 that transfers a data voltage DV (or a reference voltage VREF) transferred through the data line DL in response to a scan signal SS, a storage capacitor CST that stores the data voltage DV transferred by the switching transistor T2, a driving transistor T1 that generates a driving current based on the data voltage DV stored in the storage capacitor CST, the OLED EL that emits light in response to the driving current flowing from a line of a first power supply voltage ELVDD to a line of a second power supply voltage ELVSS, and a sensing transistor T3 that connects a node NO between the driving transistor T1 and the OLED EL to the sensing line SL in response to a sensing signal SSEN.

According to some example embodiments, as illustrated in FIG. 2, the driving transistor, the switching transistor T2 and the sensing transistor T3 may be implemented with (but embodiments are not limited to) NMOS transistors. However, a configuration of the pixel PX according to some example embodiments may not be limited to the example of FIG. 2. Further, according to some example embodiments, the display panel 110 may be an inorganic light emitting diode display panel, a quantum dot light emitting diode display panel, a liquid crystal display (LCD) panel, or any other suitable display panel.

The scan driver 120 may provide scan signals SS and/or sensing signals SSEN to the plurality of pixels PX based on a scan control signal SCTRL received from the controller 160. According to some example embodiments, the scan control signal SCTRL may include, but not limited to, a scan start signal and a scan clock signal. According to some example embodiments, the scan driver 120 may be integrated or formed in a peripheral portion of the display panel 110. According to some example embodiments, the scan driver 120 may be implemented with one or more integrated circuits.

The data driver 130 may provide the data voltages DV to the plurality of pixels PX through the plurality of data lines DL based on a data control signal DCTRL and compensated image data CDAT received from the controller 160. According to some example embodiments, the data control signal DCTRL may include, but not limited to, an output data enable signal, a horizontal start signal and a load signal. According to some example embodiments, the data driver 130 and the sensing circuit 140 may be implemented with at least one single integrated circuit. The single integrated circuit including the data driver 130 and the sensing circuit 140 may be referred to as a readout-source driver integrated circuit (RSIC).

According to some example embodiments, the data driver 130 and the controller 160 may be implemented with at least one single integrated circuit. The single integrated circuit including the data driver 130 and the controller 160 may be referred to as a timing controller embedded data driver (TED). According to some example embodiments, the data driver 130, the sensing circuit 140 and the controller 160 may be implemented with separate integrated circuits.

The sensing circuit 140 may be coupled to the plurality of sensing lines SL of the display panel 110, and may sense driving characteristics (e.g., threshold voltages VTH and/or mobility) of the driving transistors T1 of the plurality of pixels PX through the plurality of sensing lines SL. For example, as illustrated in FIGS. 1 and 2, in a sensing period, the data driver 130 may provide the reference voltage VREF to the plurality of pixels PX through the plurality of data lines DL, the nodes NO between the driving transistors T1 and the OLEDs EL in the plurality of pixels PX may have voltages VREF-VTH where the threshold voltages VTH of the driving transistors T1 are subtracted from the reference voltage VREF, and the sensing circuit 140 may receive a plurality of sensing voltages VSEN, or the voltages VREF-VTH where the threshold voltages VTH are subtracted from the reference voltage VREF from the plurality of pixels PX through the plurality of sensing lines SL.

In the sensing period, the second power supply voltage ELVSS may be adjusted to have a voltage level substantially the same as a voltage level of the first power supply voltage ELVDD, and thus the OLEDs EL may not emit light. Further, the sensing circuit 140 may generate sensing data SD corresponding to differences between the reference voltage VREF and the plurality of sensing voltages VSEN, or corresponding to the threshold voltages VTH of the driving transistors T1 of the plurality of pixels PX.

According to some example embodiments, the sensing circuit 140 may include (but embodiments are not limited to) an analog-to-digital converter (ADC) for converting the threshold voltages VTH into the sensing data SD. The controller 160 may receive the sensing data SD from the sensing circuit 140, and may write the sensing data SD to the sensing data memory 150. According to some example embodiments, the sensing circuit 140 may generate the sensing data SD when the display device 100 is manufactured (or before the plurality of pixels PX is degraded), when the display device 100 is powered on or off, and/or periodically during an operation of the display device 100.

The sensing data memory 150 may store the sensing data SD representing the driving characteristics (e.g., the threshold voltages VTH and/or the mobility) of the driving transistors T1 of the plurality of pixels PX. According to some example embodiments, when the display device 100 is manufactured or before the plurality of pixels PX is degraded, the sensing data SD including a plurality of threshold voltage data representing the threshold voltages VTH of the driving transistors T1 of the plurality of pixels PX may be stored in the sensing data memory 150, and total threshold voltage data calculated by summing or adding the plurality of threshold voltage data may be further stored, as initial total threshold voltage data before the plurality of pixels PX is degraded, in the sensing data memory 150. Further, after a driving time of the display device 100 is increased, or after the plurality of pixels PX is degraded, the sensing data SD of the sensing data memory 150 may be updated periodically or non-periodically.

The controller 160 (e.g., a timing controller (TCON)) may receive input image data IDAT and a control signal CTRL from an external host processor (e.g., a graphic processing unit (GPU), an application processor (AP) or a graphic card). According to some example embodiments, the input image data IDAT may be RGB image data including red image data, green image data and blue image data. According to some example embodiments, the control signal CTRL may include (but embodiments are not limited to) a vertical synchronization signal, a horizontal synchronization signal, an input data enable signal, a master clock signal, etc. The controller 160 may control an operation of the scan driver 120 by providing the scan control signal SCTRL to the scan driver 120, and may control an operation of the data driver 130 by providing the compensated image data CDAT and the data control signal DCTRL to the data driver 130.

As a driving time of the display device 100 increases, the plurality of pixels PX may be degraded. The sensing circuit 140 may generate the sensing data SD by sensing the threshold voltages VTH of the driving transistors T1 of the plurality of degraded pixels PX, and the sensing data memory 150 may store the sensing data SD. The controller 160 may generate the compensated image data CDAT by compensating the input image data DAT based on the sensing data SD stored in the sensing data memory 150, and the data driver 130 may provide the data voltages DV to the plurality of pixels PX based on the compensated image data CDAT.

Because the threshold voltages VTH of the driving transistors T1 of the plurality of degraded pixels PX are reflected in the data voltages DV generated based on the compensated image data CDAT, the plurality of pixels PX may emit light with uniform luminance based on the data voltages DV generated based on the compensated image data CDAT. However, in this case, the threshold voltage VTH is added to each data voltage DV, power consumption of the display device 100 may be increased, the degradation of the plurality of pixels PX, or the degradation of the driving transistors T1 may be accelerated.

To reduce the power consumption of the display device 100, and to reduce or recover the degradation of the plurality of pixels PX, the controller 160 of the display device 100 according to some example embodiments may determine a total threshold voltage shift amount for the driving transistors T1 of the plurality of pixels PX based on the sensing data SD, may determine total luminance data based on the input image data IDAT, may determine a frame stress based on the total luminance data and the total threshold voltage shift amount, may determine a target compensation voltage level based on the frame stress, and may generate the compensated image data CDAT by compensating the input image data IDAT based on the target compensation voltage level.

For example, the controller 160 may generate a plurality of pixel compensation data based on differences between the target compensation voltage level and a plurality of threshold voltage levels corresponding to the plurality of threshold voltage data included in the sensing data SD, and may generate the compensated image data CDAT by adding the plurality of pixel compensation data to the input image data IDAT. The data driver 130 may provide the data voltages DV to the plurality of pixels PX based on the compensated image data CDAT.

According to some example embodiments, the controller 160 may calculate the frame stress by summing (or adding) the total luminance data and the total threshold voltage shift amount, and may determine the target compensation voltage level such that the target compensation voltage level increases as the frame stress, or the sum of the total luminance data and the total threshold voltage shift amount increases. Thus, the target compensation voltage level may be determined according to the frame stress that is calculated by summing the total luminance data corresponding to total luminance (or total brightness) of an image by the input image data IDAT and the total threshold voltage shift amount corresponding to a degradation degree of the plurality of pixels PX, or a degradation degree of the driving transistors T1, and the data voltages DV may be generated based on the target compensation voltage level. Accordingly, in a case where the total luminance (or the total brightness) of the image by the input image data IDAT is excessively high, the data voltage DV may be decreased by adjusting the target compensation voltage level, and thus the power consumption of the display device 100 may be reduced. Further, in a case where the plurality of pixels PX, or the driving transistors T1 are excessively degraded, the data voltage DV may be decreased by adjusting the target compensation voltage level, and thus a degradation progress of the driving transistors T1 may be delayed.

To perform these operations, as illustrated in FIG. 3, the controller 160 of the display device 100 according to some example embodiments may include a threshold voltage shift calculating block 310, a frame stress calculating block 320, a compensation target determining block 350 and a data compensation block 360.

The threshold voltage shift calculating block 310 may determine the total threshold voltage shift amount TVTHSA for the driving transistors T1 of the plurality of pixels PX based on the sensing data SD. According to some example embodiments, the threshold voltage shift calculating block 310 may calculate current total threshold voltage data by summing the plurality of threshold voltage data included in the sensing data SD, and may calculate the total threshold voltage shift amount TVTHSA by subtracting the initial total threshold voltage data before the plurality of pixels PX is degraded stored in the sensing data memory 150 from the current total threshold voltage data. Further, according to some example embodiments, the threshold voltage shift calculating block 310 may reflect the input image data IDAT representing current input gray levels, and/or a current driving condition, such as a current temperature, in calculating the current total threshold voltage data and/or the total threshold voltage shift amount TVTHSA.

The frame stress calculating block 320 may determine the total luminance data TLD based on the input image data IDAT, and may determine the frame stress FS based on the total luminance data TLD and the total threshold voltage shift amount TVTHSA. According to some example embodiments, as illustrated in FIG. 3, the frame stress calculating block 320 may include a total luminance calculator 330 and an adder 340. The total luminance calculator 330 may calculate the total luminance data TLD by summing a plurality of pixel data for the plurality of pixels PX included in the input image data IDAT.

The adder 340 may calculate the frame stress FS by summing (or adding) the total threshold voltage shift amount TVTHSA and the total luminance data TLD. According to some example embodiments, the total luminance calculator 330 may calculate the frame stress FS in any manner such that the frame stress FS may increase as the total luminance data TLD increase and may increase as the total threshold voltage shift amount TVTHSA increases. For example, the total luminance calculator 330 may calculate the frame stress FS by multiplying the total luminance data TLD by a coefficient corresponding to the total threshold voltage shift amount TVTHSA.

The compensation target determining block 350 may determine the target compensation voltage level TCVL based on the frame stress FS. The compensation target determining block 350 may determine the target compensation voltage level TCVL such that the target compensation voltage level TCVL increases as the frame stress FS increases. According to some example embodiments, the compensation target determining block 350 may compare the frame stress FS with a reference stress, may determine the target compensation voltage level TCVL as a default compensation voltage level (e.g., about 0V) when the frame stress FS is less than or equal to the reference stress, and may increase the target compensation voltage level TCVL in linearly proportional to the frame stress FS as the frame stress FS increases when the frame stress FS is greater than the reference stress.

For example, the compensation target determining block 350 may store parameters of a first order equation, such as a slope parameter and an offset parameter to increase the target compensation voltage level TCVL in linearly proportional to the frame stress FS. According to some example embodiments, the compensation target determining block 350 may compare the frame stress FS with the reference stress, may determine the target compensation voltage level TCVL as the default compensation voltage level (e.g., about 0 volts) when the frame stress FS is less than or equal to the reference stress, and may increase the target compensation voltage level TCVL by using an N-th order equation of the frame stress FS as the frame stress FS increases when the frame stress FS is greater than the reference stress, where N is an integer greater than 1. For example, the compensation target determining block 350 may include a lookup table to increase the target compensation voltage level TCVL by using the N-th order equation of the frame stress FS, or to determine the target compensation voltage level TCVL corresponding to the frame stress FS.

According to some example embodiments, the compensation target determining block 350 may store M frame stresses in M frame periods, where M is an integer greater than 0, may calculate an average of the M frame stresses, and may determine the target compensation voltage level TCVL according to the average of the M frame stresses. Accordingly, even if the input image data IDAT, or the total luminance data TLD are drastically changed, the target compensation voltage level TCVL may be prevented from being drastically changed.

Further, according to some example embodiments, in a case where the frame stress FS is changed from a first frame stress (by more than a reference amount (e.g., a set or predetermined reference amount)) to a second frame stress, the compensation target determining block 350 may gradually change the target compensation voltage level TCVL from a first target compensation voltage level corresponding to the first frame stress to a second target compensation voltage level corresponding to the second frame stress for a transition time corresponding to a plurality of frame periods. Accordingly, the target compensation voltage level TCVL may be smoothly changed, and thus luminance (or brightness) of an image displayed by the display panel 110 may be smoothly changed.

Further, according to some example embodiments, the compensation target determining block 350 may receive a dimming signal representing a dimming level, and may determine the target compensation voltage level TCVL based on the frame stress FS and the dimming signal. For example, the compensation target determining block 350 may determine the target compensation voltage level TCVL such that the target compensation voltage level TCVL increases as the frame stress FS increases and the target compensation voltage level TCVL increases as the dimming level increases (or a luminance level (or a brightness level) decreases). Accordingly, a minute dimming mode may be implemented by using the target compensation voltage level TCVL that can be minutely adjusted or tuned.

The data compensation block 360 may generate the compensated image data CDAT by compensating the input image data IDAT based on the target compensation voltage level TCVL. According to some example embodiments, the data compensation block 360 may generate a plurality of pixel compensation data based on differences between the target compensation voltage level TCVL and a plurality of threshold voltage levels corresponding to the plurality of threshold voltage data, and may generate the compensated image data CDAT by adding the plurality of pixel compensation data to the input image data IDAT.

The data compensation block 360 may provide the compensated image data CDAT to the data driver 130, and the data driver 130 may provide the data voltages DV corresponding to the compensated image data CDAT to the plurality of pixels PX. For example, in a case where the target compensation voltage level TCVL is determined as the default compensation voltage level of about 0 volts, the pixel compensation data corresponding to the threshold voltage VTH of the driving transistor T1, or threshold voltage data may be added to each pixel data of the input image data IDAT, and the data voltage DV where the threshold voltage VTH is added to a voltage corresponding to a gray level of the pixel data may be applied to each pixel PX.

According to some example embodiments, in a case where the target compensation voltage level TCVL is determined as about 0.2 volts higher than the default compensation voltage level, the pixel compensation data corresponding to a difference between the threshold voltage VTH of the driving transistor T1 and about 0.2 volts may be added to each pixel data of the input image data IDAT, and the data voltage DV where the difference between the threshold voltage VTH and about 0.2 volts is added to a voltage corresponding to a gray level of the pixel data may be applied to each pixel PX. In this case, the data voltage DV may be decreased compared with a case where the target compensation voltage level TCVL is determined as the default compensation voltage level of about 0 volts, the power consumption of the display device 100 may be reduced, and the degradation progress of the driving transistors T1 may be delayed.

According to some example embodiments, the plurality of pixels PX may include red pixels, green pixels and blue pixels, and determining the total threshold voltage shift amount TVTHSA, determining the total luminance data TLD, determining the frame stress FS and determining the target compensation voltage level TCVL may be performed per color of the plurality of pixels PX. For example, the threshold voltage shift calculating block 310 may determine, as the total threshold voltage shift amount TVTHSA, a red total threshold voltage shift amount for the red pixels, a green total threshold voltage shift amount for the green pixels, and a blue total threshold voltage shift amount for the blue pixels.

The frame stress calculating block 320 may determine, as the total luminance data TLD, red total luminance data for the red pixels, green total luminance data for the green pixels, and blue total luminance data for the blue pixels. Further, as the frame stress FS, the frame stress calculating block 320 may determine a red frame stress based on the red total luminance data and the red total threshold voltage shift amount, may determine a green frame stress based on the green total luminance data and the green total threshold voltage shift amount, and may determine a blue frame stress based on the blue total luminance data and the blue total threshold voltage shift amount.

The compensation target determining block 350 may determine, as the target compensation voltage level TCVL, a red target compensation voltage level corresponding to the red frame stress, a green target compensation voltage level corresponding to the green frame stress, and a blue target compensation voltage level corresponding to the blue frame stress. The data compensation block 360 may generate the compensated image data CDAT by compensating the input image data DAT based on the red target compensation voltage level, the green target compensation voltage level and the blue target compensation voltage level. In this case, because the red, green and blue target compensation voltage levels are determined respectively corresponding to the red, green and blue pixels, a color coordinate distortion caused by a change of the target compensation voltage level TCVL may not occur.

Further, according to some example embodiments, the display panel 110 may be divided into a plurality of pixel blocks, and determining the total threshold voltage shift amount TVTHSA, determining the total luminance data TLD, determining the frame stress FS and determining the target compensation voltage level TCVL may be performed per pixel block. For example, the threshold voltage shift calculating block 310 may determine, as the total threshold voltage shift amount TVTHSA, a plurality of block total threshold voltage shift amounts for the plurality of pixel blocks.

The frame stress calculating block 320 may determine, as the total luminance data TLD, a plurality of block total luminance data for the plurality of pixel blocks, and may determine, as the frame stress FS, a plurality of block frame stresses based on the plurality of block total luminance data and the plurality of block total threshold voltage shift amounts. The compensation target determining block 350 may determine, as the target compensation voltage level TCVL, a plurality of block target compensation voltage levels for the plurality of pixel blocks. The data compensation block 360 may generate the compensated image data CDAT by compensating the input image data IDAT based on the plurality of block target compensation voltage levels.

Further, according to some example embodiments, in a case where the input image data are black image data representing a 0-gray level (or low gray image data representing a gray level lower than a reference gray level), the controller 160 may allow the degradation of the driving transistors T1 to be reduced or recovered. For example, the controller 160 may receive the black image data as the input image data IDAT from the external host processor, or may generate the input image data IDAT corresponding to the black image data in an off mode or a standby mode of the display device 100.

In response to the received or generated black image data, the controller 160 may determine the target compensation voltage level TCVL as a positive voltage level, and may generate the compensated image data CDAT representing a negative gray level based on the positive target compensation voltage level TCVL. The data driver 130 may provide the data voltages DV (having a negative voltage level or lower than the threshold voltage VTH) corresponding to the compensated image data CDAT representing the negative gray level to the plurality of pixels PX, and the threshold voltages VTH of the driving transistors T1 of the plurality of pixels PX may be shifted in a negative direction based on the data voltages DV. Thus, the degradation of the driving transistors T1 may be reduced or recovered.

As described above, in the display device 100 according to some example embodiments, the frame stress FS may be determined based on the total luminance data TLD corresponding to the total luminance (or the total brightness) of the image by the input image data IDAT and the total threshold voltage shift amount TVTHSA corresponding to the degradation degree of the plurality of pixels PX, or the degradation degree of the driving transistors T1, and the target compensation voltage level TCVL may be determined according to the frame stress FS. Accordingly, in the display device 100 according to some example embodiments, the power consumption may be reduced, the degradation of the driving transistors T1 may be reduced or recovered, and the minute dimming mode may be implemented.

Figure 4:
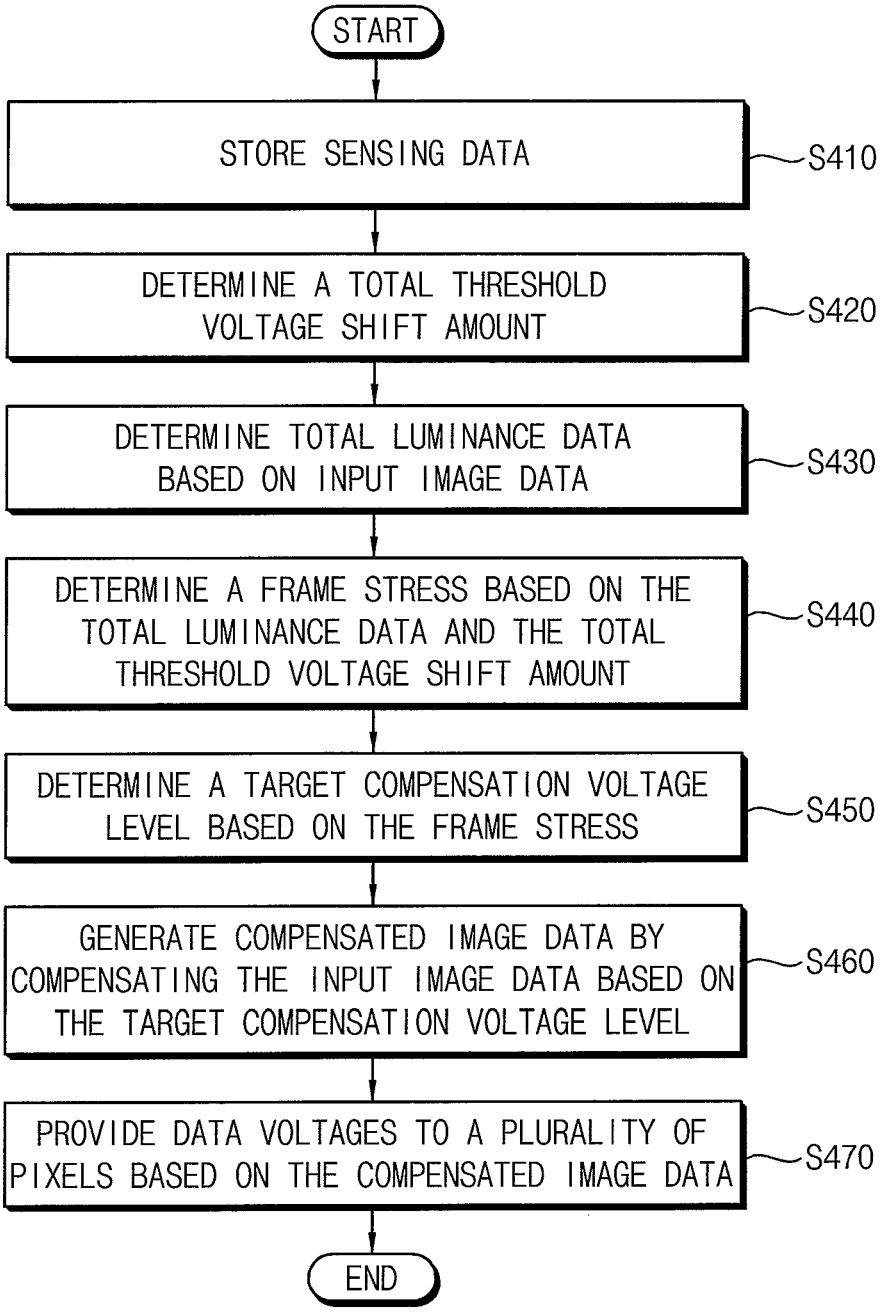
FIG. 4 is a flowchart illustrating a method of operating a display device according to some example embodiments.
Figure 5:
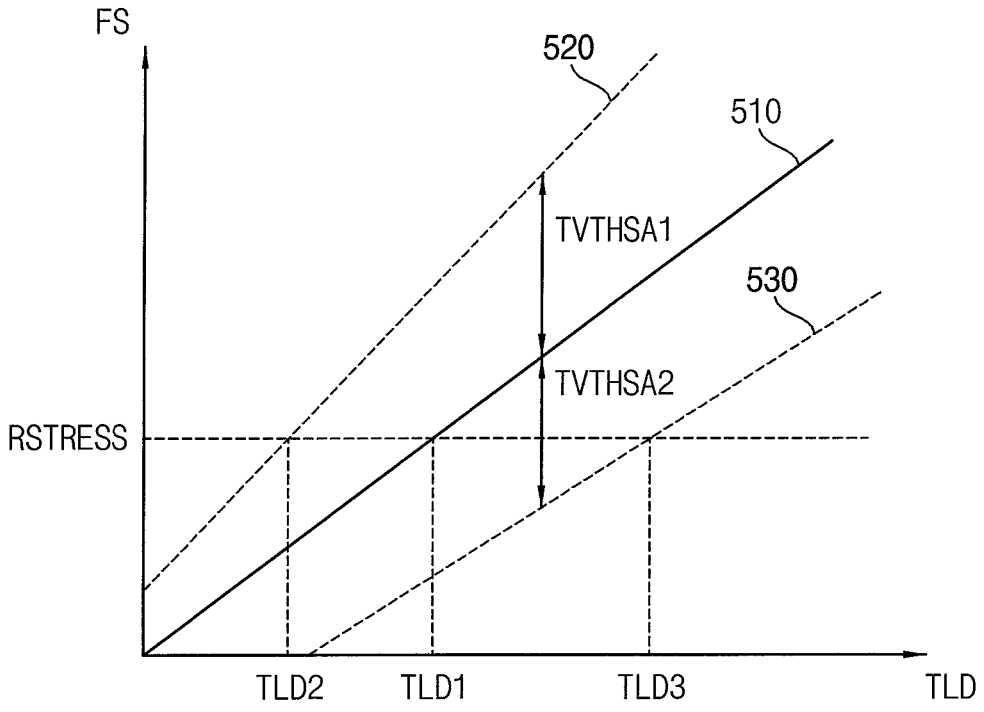
FIG. 5 is a diagram illustrating examples of a frame stress according to some example embodiments.
Figure 6:
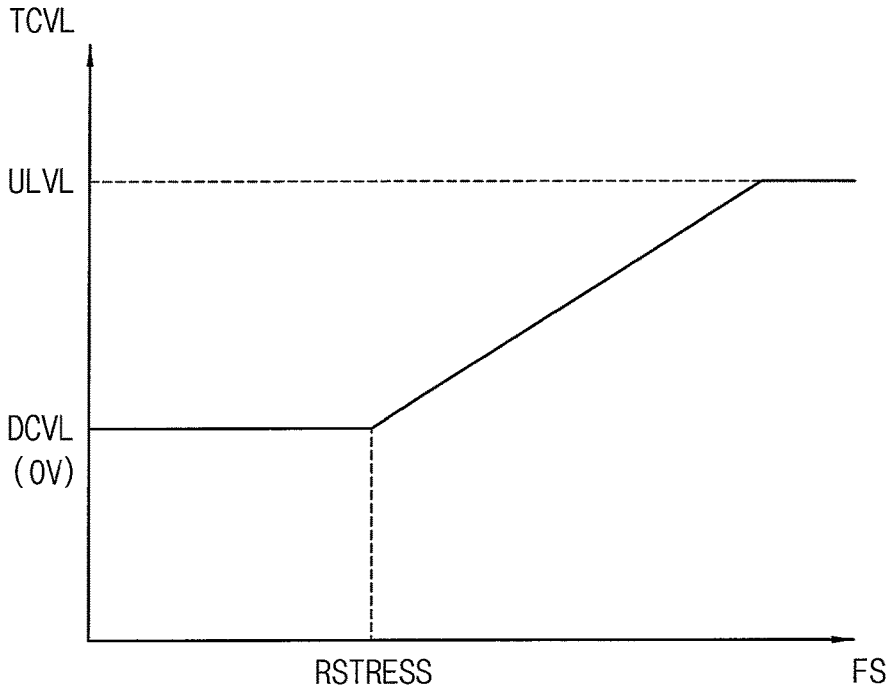
FIG. 6 is a diagram illustrating an example of a target compensation voltage level according to a frame stress according to some example embodiments.
Figure 7:
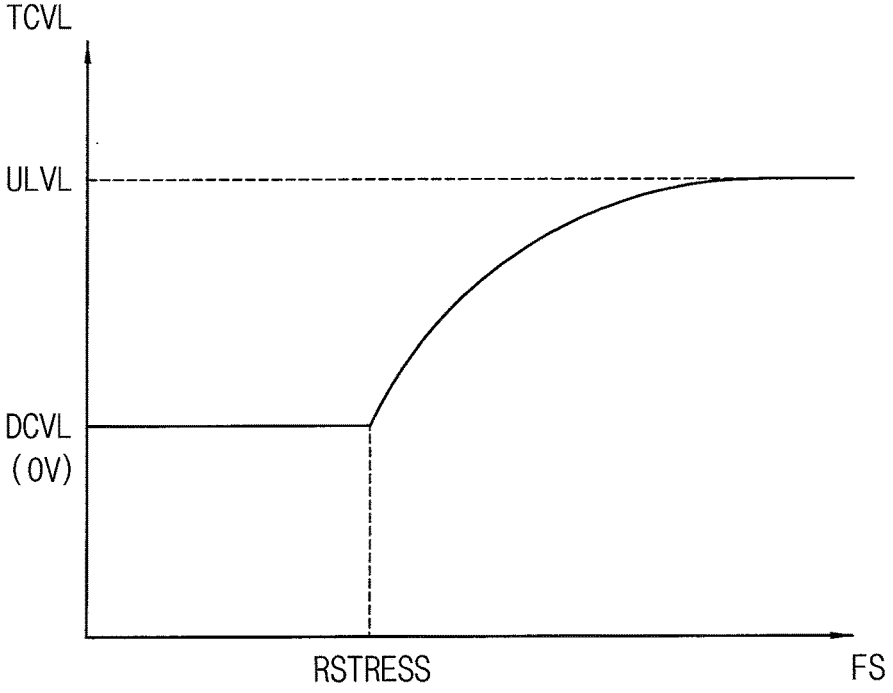
FIG. 7 is a diagram illustrating another example of a target compensation voltage level according to a frame stress according to some example embodiments.
Figure 8A:
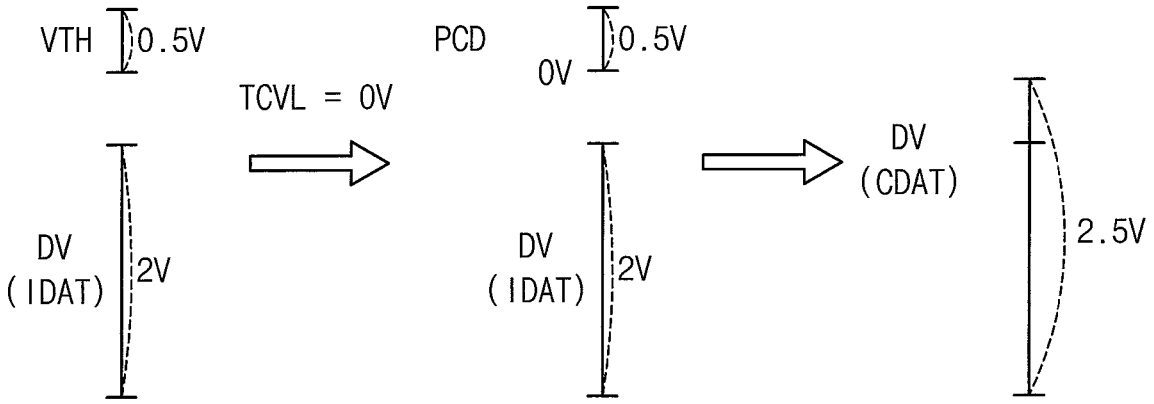
FIG. 8A is a diagram illustrating an example of a data voltage corresponding to compensated image data in a case where a target compensation voltage level is determined as a default compensation voltage level.
Figure 8B:
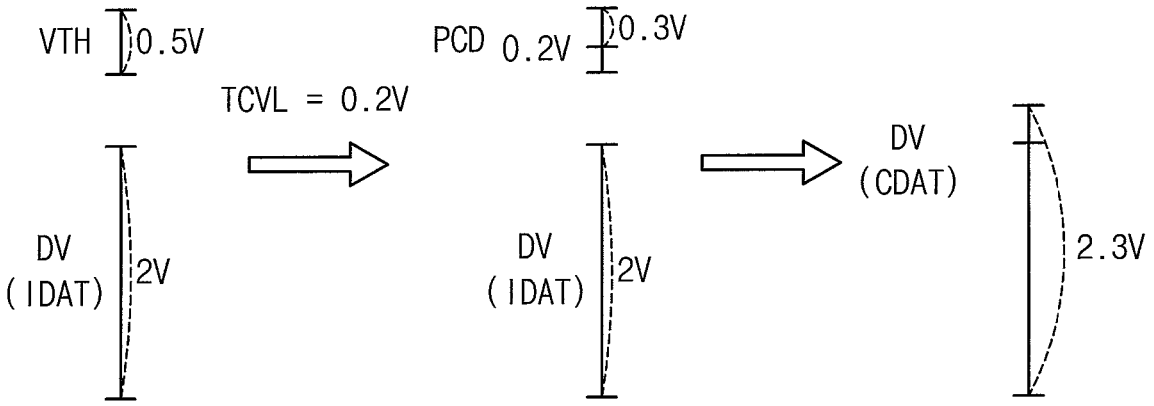
FIG. 8B is a diagram illustrating an example of a data voltage corresponding to compensated image data in a case where a target compensation voltage level is determined as a voltage level higher than a default compensation voltage level.

FIG. 4 is a flowchart illustrating a method of operating a display device according to some example embodiments, FIG. 5 is a diagram illustrating examples of a frame stress according to total luminance data, FIG. 6 is a diagram illustrating an example of a target compensation voltage level according to a frame stress according to some example embodiments, FIG. 7 is a diagram illustrating another example of a target compensation voltage level according to a frame stress according to some example embodiments, FIG. 8A is a diagram illustrating an example of a data voltage corresponding to compensated image data in a case where a target compensation voltage level is determined as a default compensation voltage level, and FIG. 8B is a diagram illustrating an example of a data voltage corresponding to compensated image data in a case where a target compensation voltage level is determined as a voltage level higher than a default compensation voltage level.

Referring to FIGS. 1, 3 and 4, in a method of operating a display device 100 including a plurality of pixels PX, a sensing data memory 150 may store sensing data SD for threshold voltages of driving transistors of the plurality of pixels PX (S410), and a threshold voltage shift calculating block 310 may determine a total threshold voltage shift amount TVTHSA for the driving transistors of the plurality of pixels PX based on the sensing data SD (S420). According to some example embodiments, the threshold voltage shift calculating block 310 may calculate current total threshold voltage data by summing a plurality of threshold voltage data included in the sensing data SD, and may calculate the total threshold voltage shift amount TVTHSA by subtracting initial total threshold voltage data before the plurality of pixels PX is degraded from the current total threshold voltage data.

A frame stress calculating block 320 may determine total luminance data TLD based on input image data DAT (S430), and may determine a frame stress FS based on the total luminance data TLD and the total threshold voltage shift amount TVTHSA (S440). According to some example embodiments, the frame stress calculating block 320 may calculate the total luminance data TLD by summing a plurality of pixel data included in the input image data IDAT, and may calculate the frame stress FS by summing the total threshold voltage shift amount TVTHSA and the total luminance data TLD.

FIG. 5 illustrates an example 510 of the frame stress FS according to the total luminance data TLD in a case where the plurality of pixels PX is not degraded, an example 520 of the frame stress FS according to the total luminance data TLD in a case where threshold voltages of the driving transistors of the plurality of pixels PX are shifted in a positive direction (or in a case where the driving transistors are degraded), and an example 530 of the frame stress FS according to the total luminance data TLD in a case where the threshold voltages of the driving transistors of the plurality of pixels PX are shifted in a negative direction.

For example, as illustrated in FIG. 5, in the case where the threshold voltages of the driving transistors of the plurality of pixels PX are shifted in the positive direction (or in the case where the driving transistors are degraded), the frame stress FS may be calculated by adding a first total threshold voltage shift amount TVTHSA1 corresponding to the positive directional shift of the threshold voltages of the driving transistors to the total luminance data TLD. Further, in the case where the threshold voltages of the driving transistors of the plurality of pixels PX are shifted in the negative direction, the frame stress FS may be calculated by subtracting a second total threshold voltage shift amount TVTHSA2 corresponding to the negative directional shift of the threshold voltages of the driving transistors from the total luminance data TLD.

Further, as illustrated in FIG. 5, in the case where the plurality of pixels PX is not degraded, the frame stress FS may be greater than a reference stress RSTRESS when the total luminance data TLD is greater than a first total luminance data TLD1. However, in the case where the driving transistors are degraded, the frame stress FS may be greater than the reference stress RSTRESS when the total luminance data TLD is greater than a second total luminance data TLD2 that is lower than the first total luminance data TLD1. Thus, in the case where the driving transistors are degraded, the frame stress FS may be greater than or equal to the reference stress RSTRESS at the relatively low second total luminance data TLD2. Further, in the case where the threshold voltages are shifted in the negative direction, the frame stress FS may be greater than the reference stress RSTRESS when the total luminance data TLD is greater than a third total luminance data TLD3 that is higher than the first total luminance data TLD1. Thus, in the case where the threshold voltages are shifted in the negative direction, the frame stress FS may be greater than or equal to the reference stress RSTRESS at the relatively high third total luminance data TLD3.

A compensation target determining block 350 may determine a target compensation voltage level TCVL based on the frame stress FS (S450). The compensation target determining block 350 may determine the target compensation voltage level TCVL such that the target compensation voltage level TCVL increases as the frame stress FS increases.

According to some example embodiments, as illustrated in FIG. 6, the compensation target determining block 350 may compare the frame stress FS with the reference stress RSTRESS, may determine the target compensation voltage level TCVL as a default compensation voltage level DCVL (e.g., about 0 volts) when the frame stress FS is less than or equal to the reference stress RSTRESS, and may increase the target compensation voltage level TCVL in linearly proportional to the frame stress FS as the frame stress FS increases when the frame stress FS is greater than the reference stress RSTRESS. For example, the compensation target determining block 350 may store parameters of a first order equation, such as a slope parameter and an offset parameter to increase the target compensation voltage level TCVL in linearly proportional to the frame stress FS. Further, according to some example embodiments, as illustrated in FIGS. 6 and 7, the compensation target determining block 350 may store a compensation target upper limit ULVL, and may determine the target compensation voltage level TCVL such that the target compensation voltage level TCVL does not exceed the compensation target upper limit ULVL.

According to some example embodiments, as illustrated in FIG. 7, the compensation target determining block 350 may compare the frame stress FS with the reference stress RSTRESS, may determine the target compensation voltage level TCVL as the default compensation voltage level DCVL (e.g., about 0 volts) when the frame stress FS is less than or equal to the reference stress RSTRESS, and may increase the target compensation voltage level TCVL by using an N-th order equation of the frame stress FS as the frame stress FS increases when the frame stress FS is greater than the reference stress RSTRESS, where N is an integer greater than 1. For example, the compensation target determining block 350 may include a lookup table to increase the target compensation voltage level TCVL by using the N-th order equation of the frame stress FS, or to determine the target compensation voltage level TCVL corresponding to the frame stress FS.

A data compensation block 360 may generate compensated image data CDAT by compensating the input image data IDAT based on the target compensation voltage level TCVL (S460), and a data driver 130 may provide data voltages DV to the plurality of pixels PX based on the compensated image data CDAT (S470). According to some example embodiments, the data compensation block 360 may generate a plurality of pixel compensation data based on differences between the target compensation voltage level TCVL and a plurality of threshold voltage levels corresponding to the plurality of threshold voltage data, and may generate the compensated image data CDAT by adding the plurality of pixel compensation data to the input image data IDAT.

For example, as illustrated in FIG. 8A, in a case where the target compensation voltage level TCVL is determined as the default compensation voltage level DCVL of about 0 volts, threshold voltage data for a pixel PX represent a threshold voltage VTH of about 0.5 volts, and input image data IDAT for the pixel PX corresponds to a data voltage DV of about 2 volts, the data compensation block 360 may determine pixel compensation data PCD for the pixel PX corresponding to a difference of about 0.5 volts between the target compensation voltage level TCVL of about 0 volts and the threshold voltage VTH of about 0.5 volts, and may generate the compensated image data CDAT corresponding to the data voltage DV of about 2.5 volts by adding the pixel compensation data PCD corresponding to about 0.5 volts to the input image data IDAT for the pixel PX.

In another example, as illustrated in FIG. 8B, in a case where the target compensation voltage level TCVL is determined as about 0.2 volts higher than the default compensation voltage level DCVL, threshold voltage data for a pixel PX represent a threshold voltage VTH of about 0.5 volts, and input image data IDAT for the pixel PX corresponds to a data voltage DV of about 2 volts, the data compensation block 360 may determine pixel compensation data PCD for the pixel PX corresponding to a difference of about 0.3 volts between the target compensation voltage level TCVL of about 0.2 volts and the threshold voltage VTH of about 0.5 volts, and may generate the compensated image data CDAT corresponding to the data voltage DV of about 2.3 volts by adding the pixel compensation data PCD corresponding to about 0.3 volts to the input image data IDAT for the pixel PX. Thus, compared with the case where the target compensation voltage level TCVL is determined as the default compensation voltage level of about 0 volts, the data voltages DV for the plurality of pixels PX may be decreased, power consumption of the display device 100 may be reduced, and a degradation progress of driving transistors of the plurality of pixels PX may be delayed.

Figure 9:
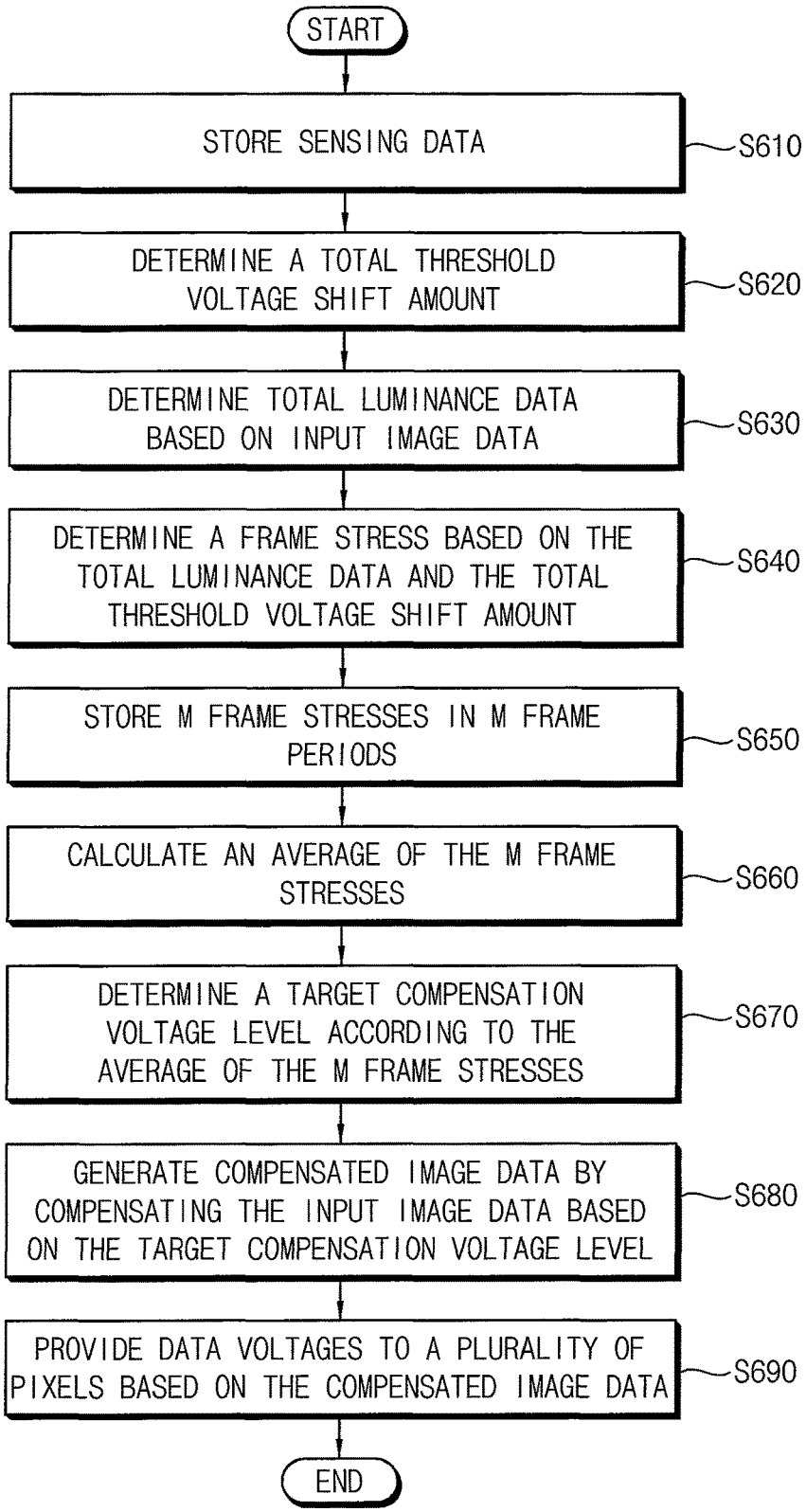
FIG. 9 is a flowchart illustrating a method of operating a display device according to some example embodiments.
Figure 10:
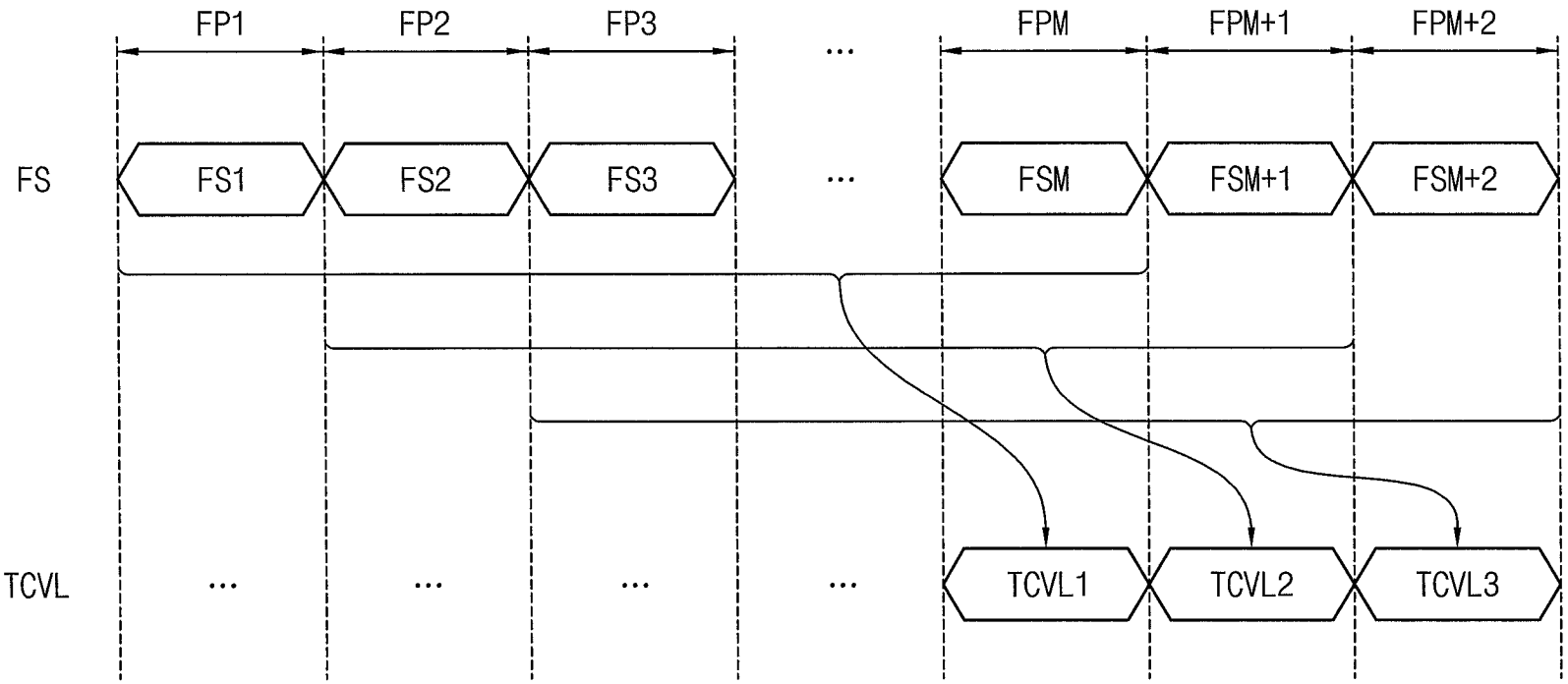
FIG. 10 is a diagram illustrating an example where a target compensation voltage level is determined according to an average of M frame stresses.

FIG. 9 is a flowchart illustrating a method of operating a display device according to some example embodiments, and FIG. 10 is a diagram illustrating an example where a target compensation voltage level is determined according to an average of M frame stresses.

Referring to FIGS. 1, 3 and 9, in a method of operating a display device 100 including a plurality of pixels PX, a sensing data memory 150 may store sensing data SD for threshold voltages of driving transistors of the plurality of pixels PX (S610), and a threshold voltage shift calculating block 310 may determine a total threshold voltage shift amount TVTHSA for the driving transistors of the plurality of pixels PX based on the sensing data SD (S620). A frame stress calculating block 320 may determine total luminance data TLD based on input image data IDAT (S630), and may determine a frame stress FS based on the total luminance data TLD and the total threshold voltage shift amount TVTHSA (S640).

A compensation target determining block 350 may store M frame stresses FS in M frame periods, where M is an integer greater than 0 (S650), may calculate an average of the M frame stresses FS (S660), and may determine a target compensation voltage level TCVL according to the average of the M frame stresses FS (S670). For example, as illustrated in FIG. 10, a first target compensation voltage level TCVL1 in an M-th frame period FPM may be determined according to an average of first through M-th frame stresses FS1 through FSM in first through M-th frame periods FP1 through FPM, a second target compensation voltage level TCVL2 in an (M+1)-th frame period FPM+1 may be determined according to an average of second through (M+1)-th frame stresses FS2 through FSM+1 in second through (M+1)-th frame periods FP2 through FPM+1, and a third target compensation voltage level TCVL3 in an (M+2)-th frame period FPM+2 may be determined according to an average of third through (M+2)-th frame stresses FS3 through FSM+2 in third through (M+2)-th frame periods FP3 through FPM+2. Accordingly, even if the input image data IDAT, or the total luminance data TLD are drastically changed, the target compensation voltage level TCVL may be prevented from being drastically changed.

A data compensation block 360 may generate compensated image data CDAT by compensating the input image data IDAT based on the target compensation voltage level TCVL (S680), and a data driver 130 may provide data voltages DV to the plurality of pixels PX based on the compensated image data CDAT (S690).

Figure 11:
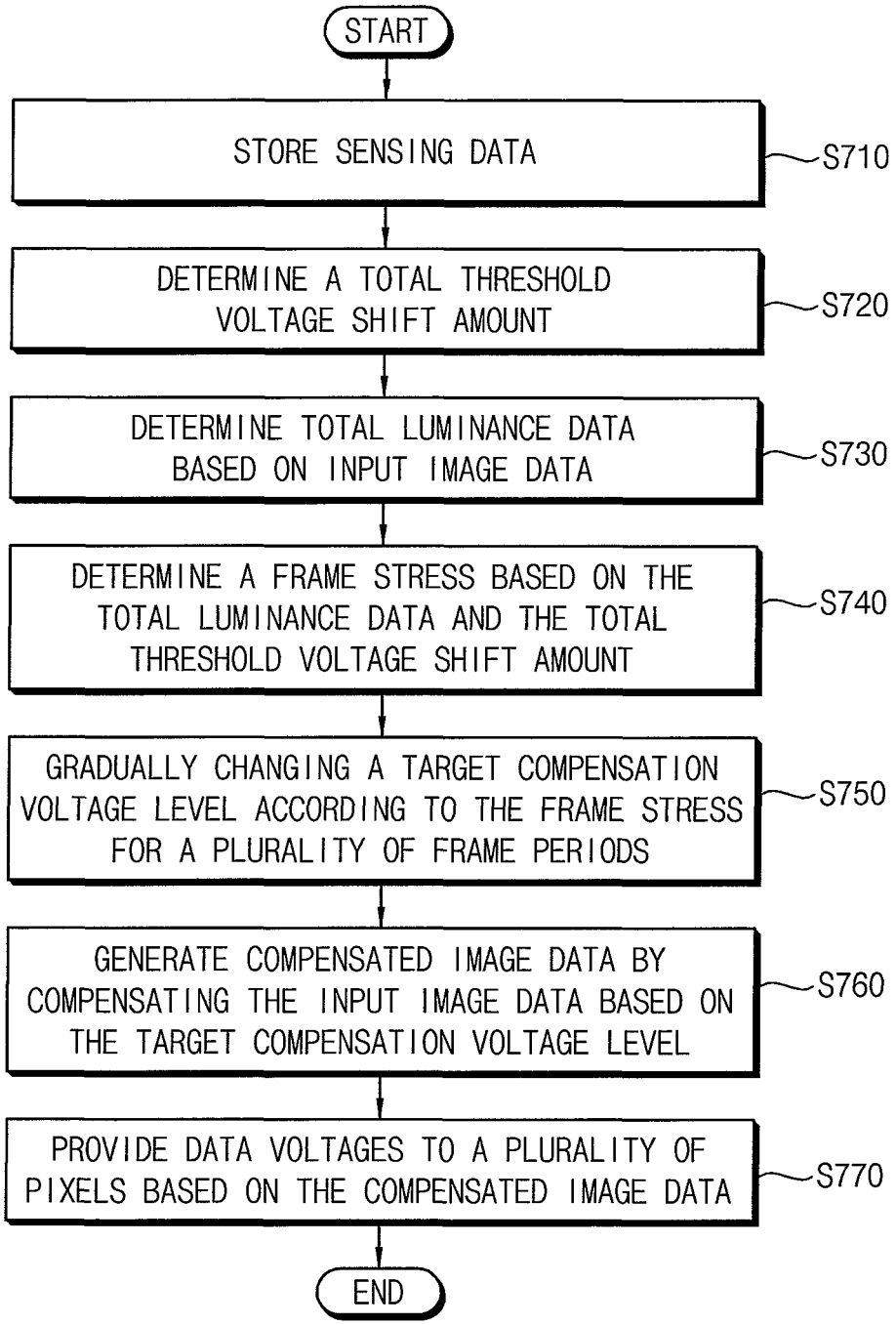
FIG. 11 is a flowchart illustrating a method of operating a display device according to some example embodiments.
Figure 12:
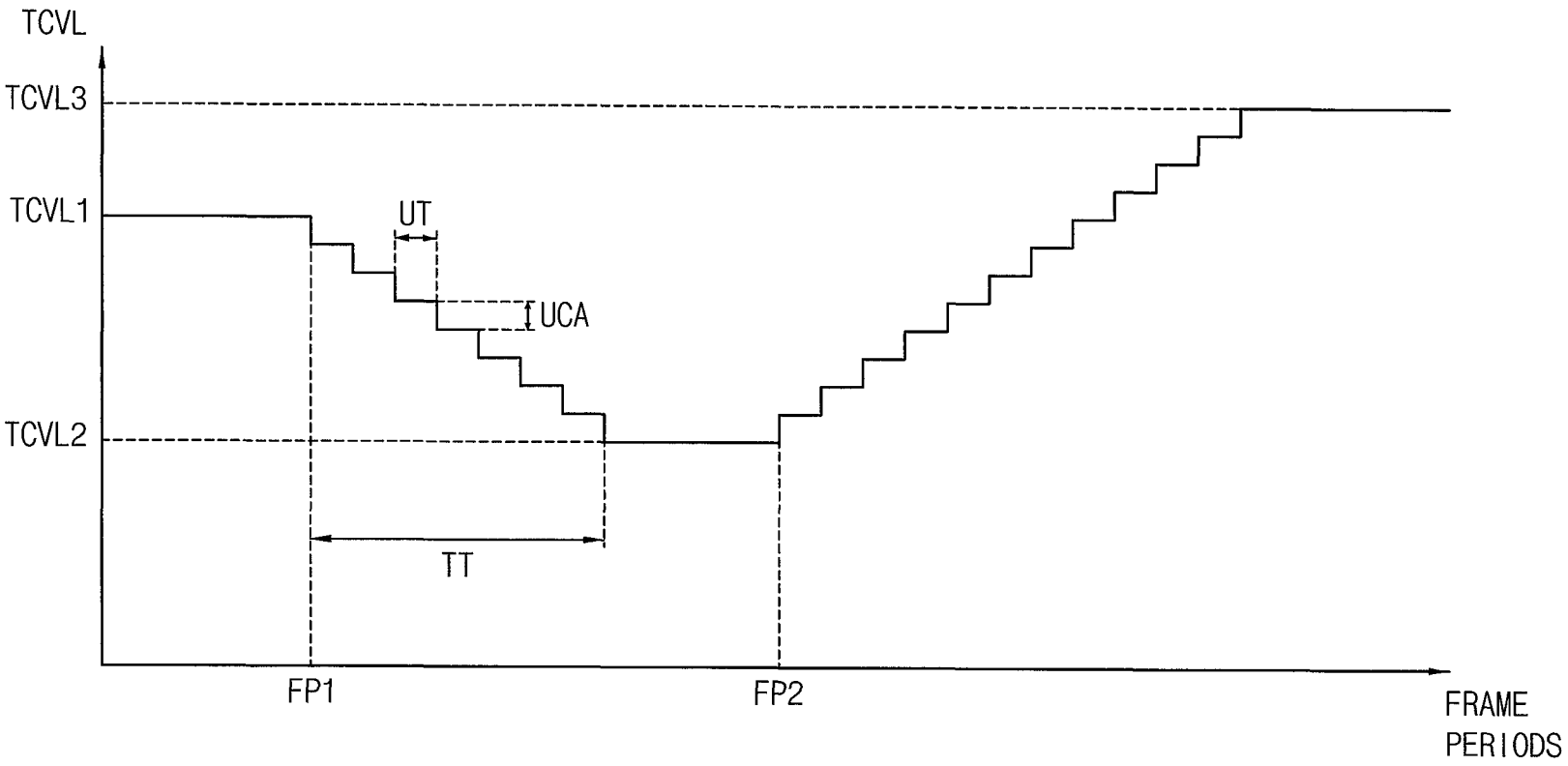
FIG. 12 is a diagram illustrating an example where a target compensation voltage level is gradually changed for a transition time corresponding to a plurality of frame periods.

FIG. 11 is a flowchart illustrating a method of operating a display device according to some example embodiments, and FIG. 12 is a diagram illustrating an example where a target compensation voltage level is gradually changed for a transition time corresponding to a plurality of frame periods.

Referring to FIGS. 1, 3 and 11, in a method of operating a display device 100 including a plurality of pixels PX, a sensing data memory 150 may store sensing data SD for threshold voltages of driving transistors of the plurality of pixels PX (S710), and a threshold voltage shift calculating block 310 may determine a total threshold voltage shift amount TVTHSA for the driving transistors of the plurality of pixels PX based on the sensing data SD (S720). A frame stress calculating block 320 may determine total luminance data TLD based on input image data IDAT (S730), and may determine a frame stress FS based on the total luminance data TLD and the total threshold voltage shift amount TVTHSA (S740).

A compensation target determining block 350 may gradually change a target compensation voltage level TCVL according to the frame stress FS for a plurality of frame periods (S750). According to some example embodiments, as illustrated in FIG. 12, in a case where the frame stress FS is changed from a first frame stress (by more than a reference amount (e.g., a set or predetermined reference amount)) to a second frame stress in a first frame period FP1, the compensation target determining block 350 may gradually change the target compensation voltage level TCVL from a first target compensation voltage level TCVL1 corresponding to the first frame stress to a second target compensation voltage level TCVL2 corresponding to the second frame stress for a transition time TT corresponding to a plurality of frame periods. For example, the compensation target determining block 350 may store a unit time UT corresponding to at least one frame period and a unit change amount UCA, and may change the target compensation voltage level TCVL by the unit change amount UCA per each unit time UT. Further, in a case where the frame stress FS is changed from the second frame stress to a third frame stress in a second frame period FP2, the compensation target determining block 350 may gradually change the target compensation voltage level TCVL from the second target compensation voltage level TCVL2 corresponding to the second frame stress to a third target compensation voltage level TCVL3 corresponding to the third frame stress. Accordingly, the target compensation voltage level TCVL may be smoothly changed, and thus luminance (or brightness) of an image displayed by a display panel 110 may be smoothly changed.

A data compensation block 360 may generate compensated image data CDAT by compensating the input image data DAT based on the target compensation voltage level TCVL (S760), and a data driver 130 may provide data voltages DV to the plurality of pixels PX based on the compensated image data CDAT (S770).

Figure 13:
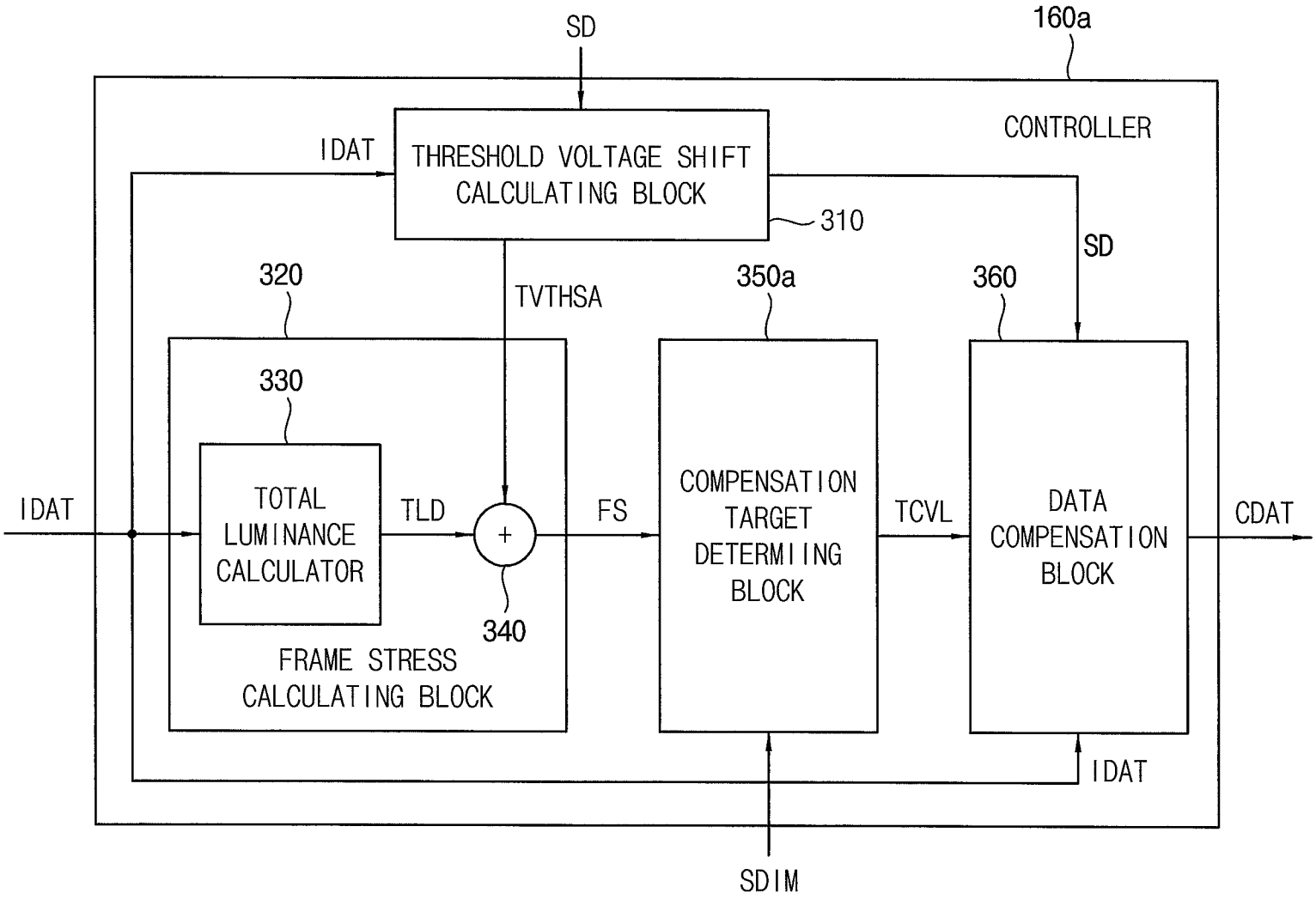
FIG. 13 is a block diagram illustrating a controller included in a display device according to some example embodiments.

FIG. 13 is a block diagram illustrating a controller included in a display device according to some example embodiments.

Referring to FIG. 13, a controller 160*a* may include a threshold voltage shift calculating block 310, a frame stress calculating block 320, a compensation target determining block 350*a* and a data compensation block 360. The controller 160*a* of FIG. 13 may have a similar configuration and a similar operation to a controller 160 of FIG. 3, except that the compensation target determining block 350*a* may further receive a dimming signal SDIM.

The compensation target determining block 350*a* may receive the dimming signal SDIM representing a dimming level, and may determine a target compensation voltage level TCVL based on a frame stress FS and the dimming signal SDIM. For example, the compensation target determining block 350*a* may determine the target compensation voltage level TCVL such that the target compensation voltage level TCVL increases as the frame stress FS increases, and the target compensation voltage level TCVL increases as the dimming level increases (or a luminance level (or a brightness level) decreases). Accordingly, a minute dimming mode may be implemented by using the target compensation voltage level TCVL that can be minutely adjusted or tuned.

Figure 14:
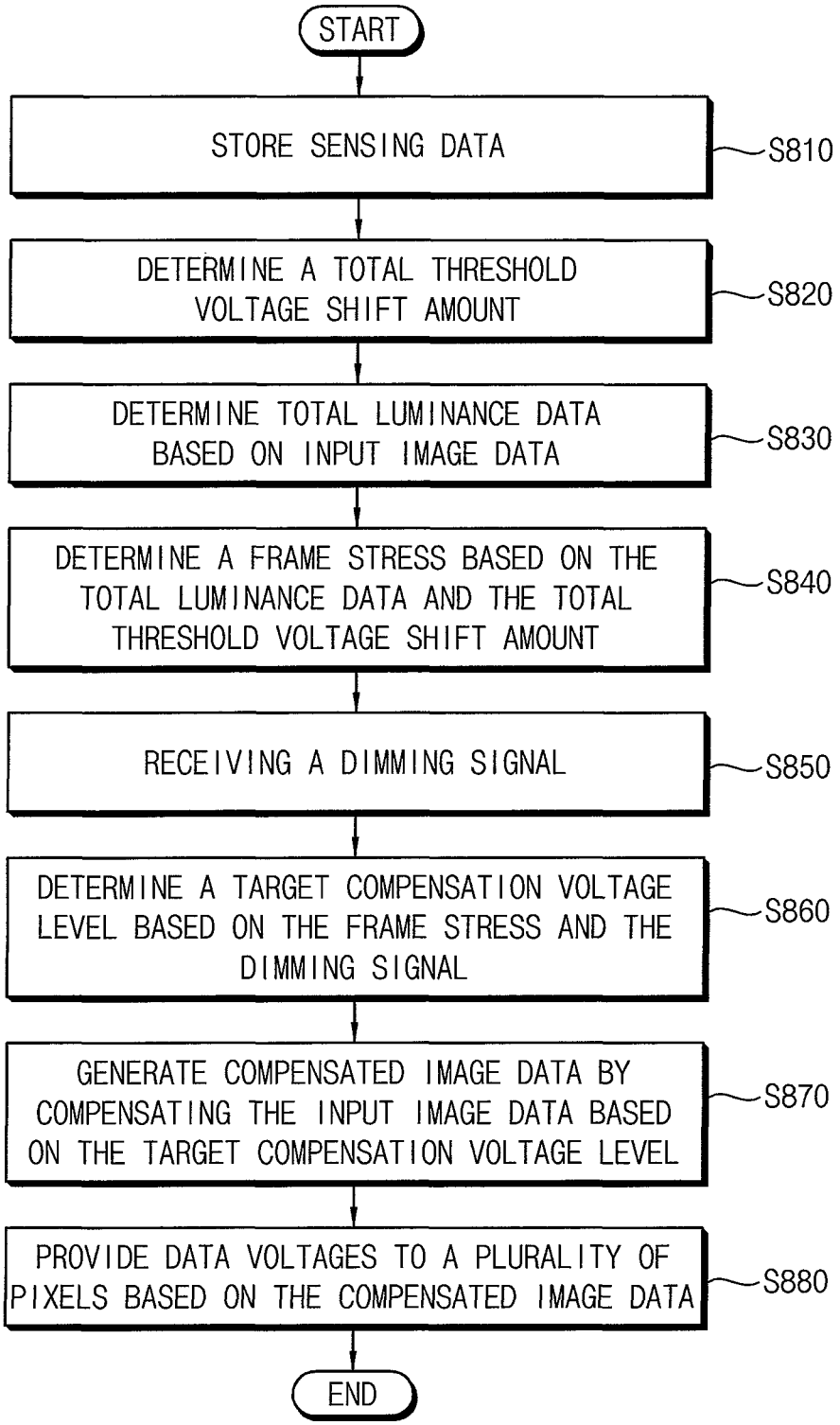
FIG. 14 is a flowchart illustrating a method of operating a display device according to some example embodiments.

FIG. 14 is a flowchart illustrating a method of operating a display device according to some example embodiments.

Referring to FIGS. 1, 13 and 14, in a method of operating a display device 100 including a plurality of pixels PX, a sensing data memory 150 may store sensing data SD for threshold voltages of driving transistors of the plurality of pixels PX (S810), and a threshold voltage shift calculating block 310 may determine a total threshold voltage shift amount TVTHSA for the driving transistors of the plurality of pixels PX based on the sensing data SD (S820). A frame stress calculating block 320 may determine total luminance data TLD based on input image data IDAT (S830), and may determine a frame stress FS based on the total luminance data TLD and the total threshold voltage shift amount TVTHSA (S840).

A compensation target determining block 350*a* may receive a dimming signal SDIM representing a dimming level (S850), and may determine a target compensation voltage level TCVL based on a frame stress FS and the dimming signal SDIM (S860). For example, the compensation target determining block 350*a* may determine the target compensation voltage level TCVL such that the target compensation voltage level TCVL increases as the frame stress FS increases, and the target compensation voltage level TCVL increases as the dimming level increases. Accordingly, a minute dimming mode may be implemented by using the target compensation voltage level TCVL that can be minutely adjusted or tuned.

A data compensation block 360 may generate compensated image data CDAT by compensating the input image data DAT based on the target compensation voltage level TCVL (S870), and a data driver 130 may provide data voltages DV to the plurality of pixels PX based on the compensated image data CDAT (S880).

Figure 15:
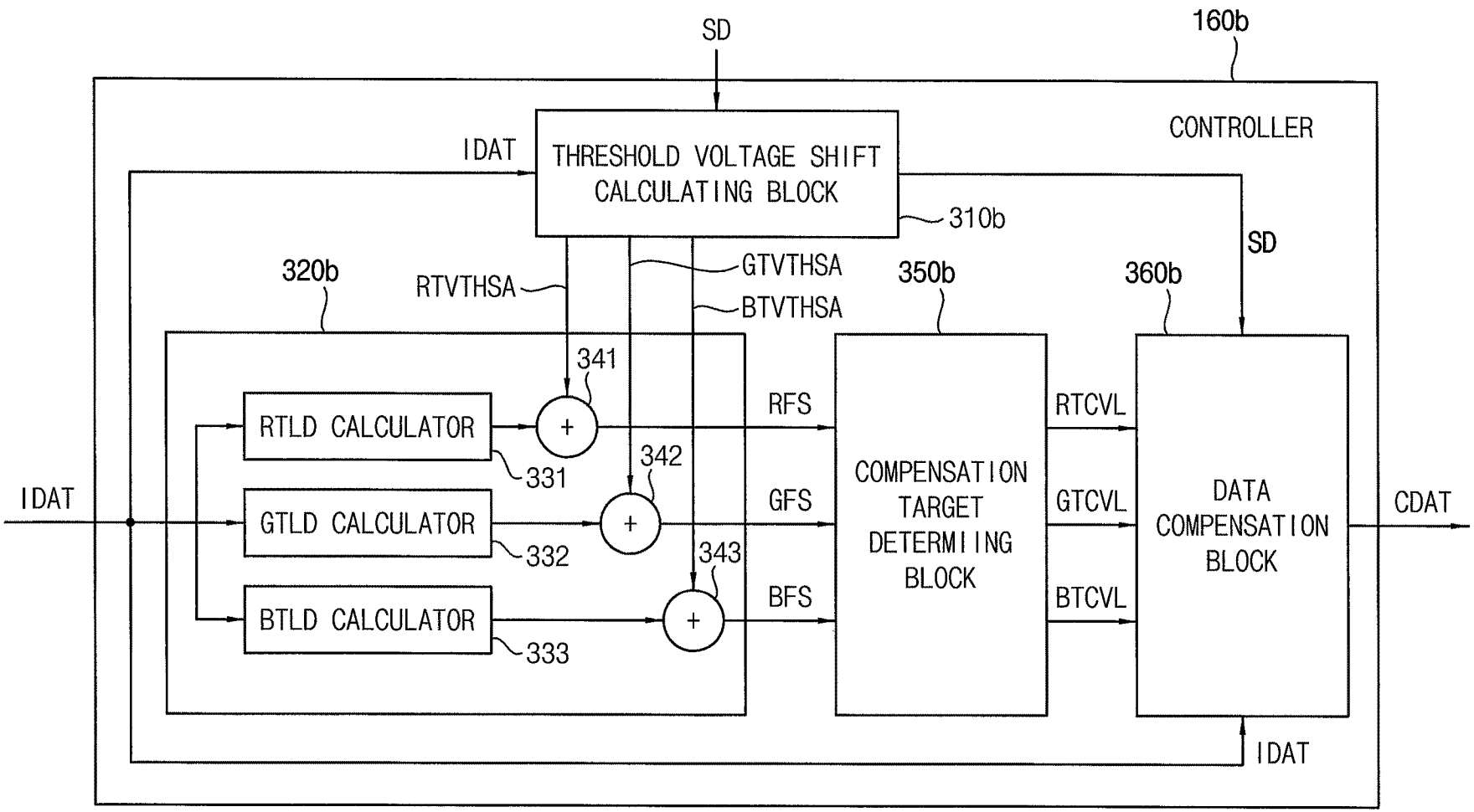
FIG. 15 is a block diagram illustrating a controller included in a display device according to some example embodiments.

FIG. 15 is a block diagram illustrating a controller included in a display device according to some example embodiments.

Referring to FIG. 15, a controller 160*b* may include a threshold voltage shift calculating block 310*b*, a frame stress calculating block 320*b*, a compensation target determining block 350*b* and a data compensation block 360*b*. A display device including the controller 160*b* may include red pixels, green pixels and blue pixels.

The threshold voltage shift calculating block 310*b* may determine a red total threshold voltage shift amount RTVTHSA for the red pixels, a green total threshold voltage shift amount GTVTHSA for the green pixels, and a blue total threshold voltage shift amount BTVTHSA for the blue pixels.

The frame stress calculating block 320*b* may include red, green and blue total luminance calculators 331, 332 and 333 and first, second and third adders 341, 342 and 343. The red total luminance calculator 331 may determine red total luminance data RTLD for the red pixels, the green total luminance calculator 332 may determine green total luminance data GTLD for the green pixels, and the blue total luminance calculator 333 may determine blue total luminance data BTLD for the blue pixels. The first adder 341 may determine a red frame stress RFS based on the red total luminance data RTLD and the red total threshold voltage shift amount RTVTHSA, the second adder 342 may determine a green frame stress GFS based on the green total luminance data GTLD and the green total threshold voltage shift amount GTVTHSA, and the third adder 343 may determine a blue frame stress BFS based on the blue total luminance data BTLD and the blue total threshold voltage shift amount BTVTHSA.

The compensation target determining block 350*b* may determine a red target compensation voltage level RTCVL corresponding to the red frame stress RFS, a green target compensation voltage level GTCVL corresponding to the green frame stress GFS, and a blue target compensation voltage level BTCVL corresponding to the blue frame stress BFS.

The data compensation block 360*b* may generate compensated image data CDAT by compensating the input image data IDAT based on the red target compensation voltage level RTCVL, the green target compensation voltage level GTCVL and the blue target compensation voltage level BTCVL. In this case, because the red, green and blue target compensation voltage levels RTCVL, GTCVL and BTCVL are determined respectively corresponding to the red, green and blue pixels, a color coordinate distortion may not occur.

Figure 16:
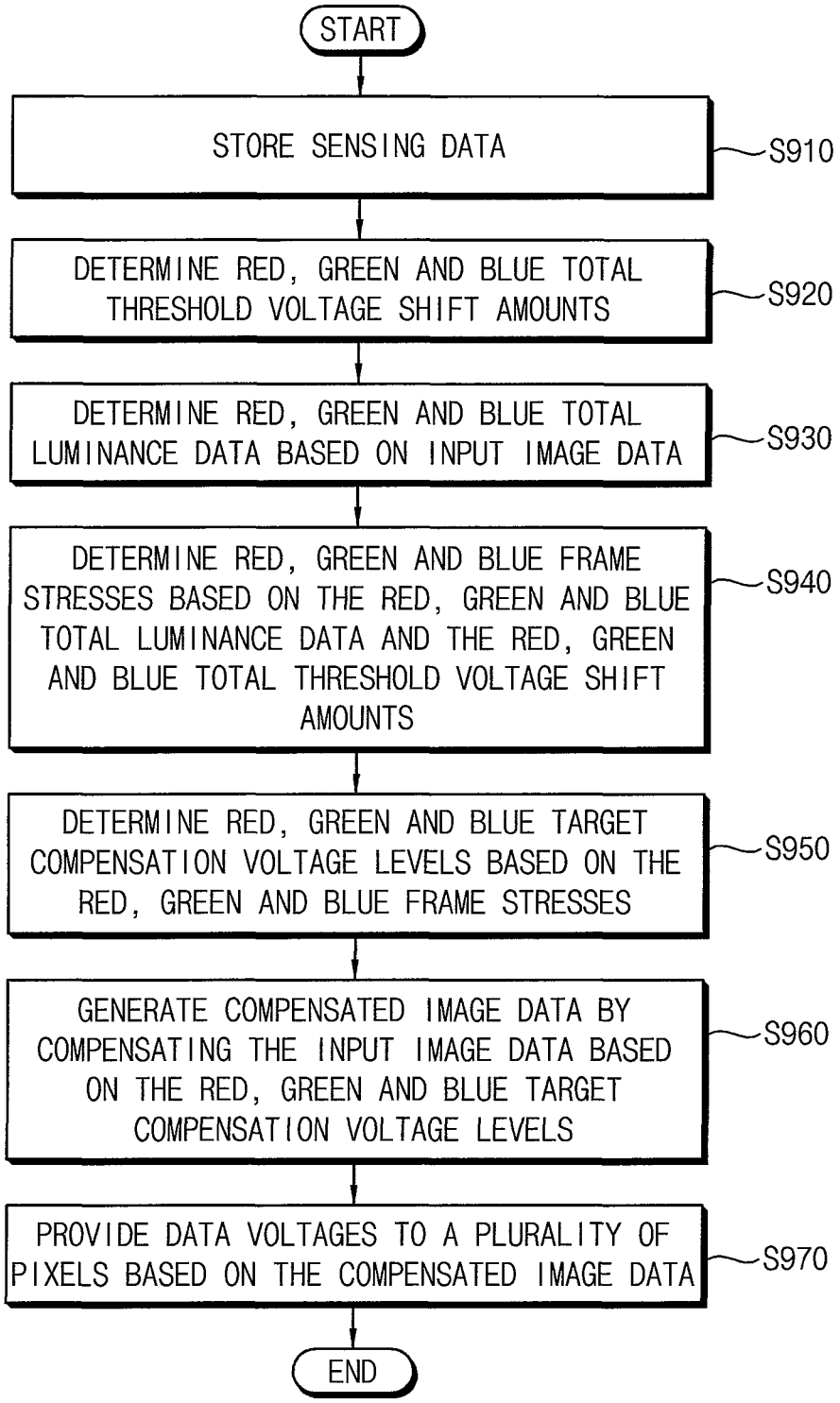
FIG. 16 is a flowchart illustrating a method of operating a display device according to some example embodiments.

FIG. 16 is a flowchart illustrating a method of operating a display device according to some example embodiments.

Referring to FIGS. 1, 15 and 16, in a method of operating a display device 100 including a plurality of pixels PX, a sensing data memory 150 may store sensing data SD for threshold voltages of driving transistors of the plurality of pixels PX (S910).

A threshold voltage shift calculating block 310*b* may determine a red total threshold voltage shift amount RTVTHSA for red pixels, a green total threshold voltage shift amount GTVTHSA for green pixels, and a blue total threshold voltage shift amount BTVTHSA for blue pixels (S920).

A frame stress calculating block 320*b* may determine red total luminance data RTLD for the red pixels, green total luminance data GTLD for the green pixels, and blue total luminance data BTLD for the blue pixels based on input image data IDAT (S930).

The frame stress calculating block 320*b* may determine a red frame stress RFS based on the red total luminance data RTLD and the red total threshold voltage shift amount RTVTHSA, may determine a green frame stress GFS based on the green total luminance data GTLD and the green total threshold voltage shift amount GTVTHSA, and may determine a blue frame stress BFS based on the blue total luminance data BTLD and the blue total threshold voltage shift amount BTVTHSA (S940).

A compensation target determining block 350*b* may determine a red target compensation voltage level RTCVL corresponding to the red frame stress RFS, a green target compensation voltage level GTCVL corresponding to the green frame stress GFS, and a blue target compensation voltage level BTCVL corresponding to the blue frame stress BFS (S950).

A data compensation block 360*b* may generate compensated image data CDAT by compensating the input image data DAT based on the red target compensation voltage level RTCVL, the green target compensation voltage level GTCVL and the blue target compensation voltage level BTCVL (S960), and a data driver 130 may provide data voltages DV to the plurality of pixels PX based on the compensated image data CDAT (S970). In this case, because the red, green and blue target compensation voltage levels RTCVL, GTCVL and BTCVL are determined respectively corresponding to the red, green and blue pixels, a color coordinate distortion may not occur.

Figure 17:
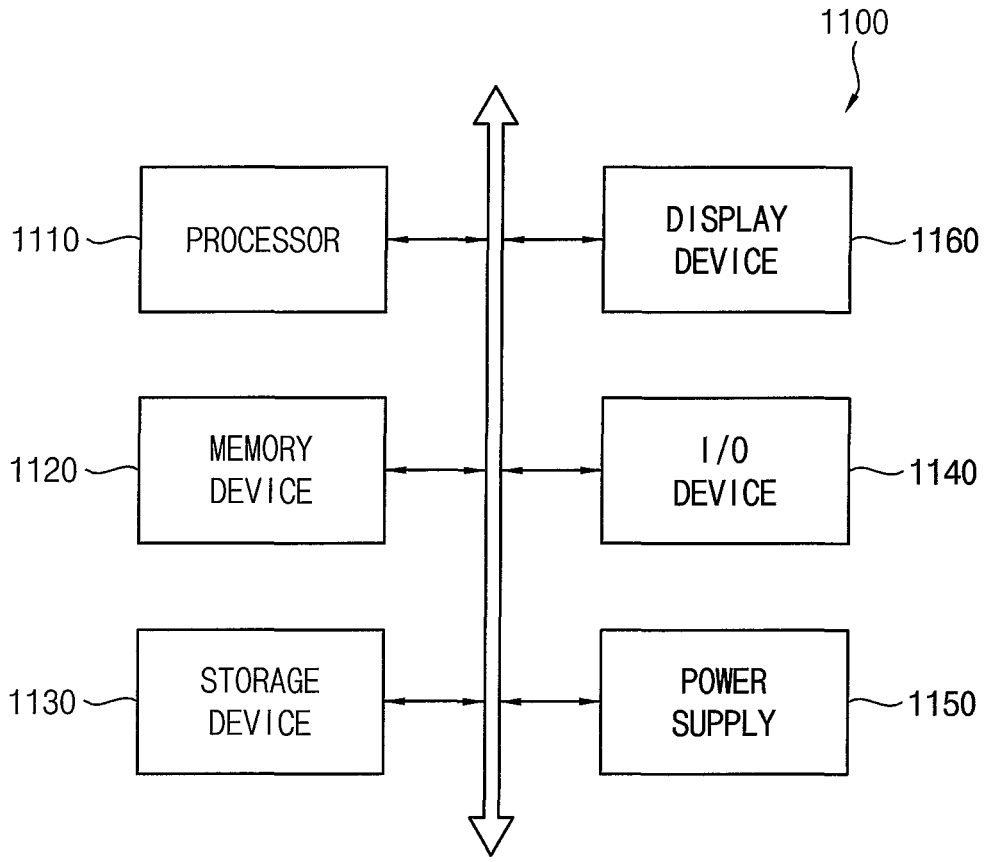
FIG. 17 is a block diagram illustrating an electronic device including a display device according to some example embodiments.

FIG. 17 is a block diagram illustrating an electronic device including a display device according to some example embodiments.

Referring to FIG. 11, an electronic device 1100 may include a processor 1110, a memory device 1120, a storage device 1130, an input/output (I/O) device 1140, a power supply 1150, and a display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, according to some example embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In the display device 1160, a frame stress may be determined based on total luminance data corresponding to total luminance (or total brightness) of an image by input image data and a total threshold voltage shift amount corresponding to a degradation degree of a plurality of pixels, or a degradation degree of driving transistors, and a target compensation voltage level may be determined according to the frame stress. Accordingly, in the display device 1160 according to some example embodiments, power consumption may be reduced, a degradation of the driving transistors may be reduced or recovered, and a minute dimming mode may be implemented.

The inventive concepts may be applied any electronic device 1100 including the display device 1160. For example, the inventive concepts may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

The foregoing is illustrative of aspects of some example embodiments and is not to be construed as limiting thereof. Although a few example embodiments have been described, those skilled in the art will readily appreciate that many modifications are possible in the example embodiments without materially departing from the novel teachings and characteristics of embodiments according to the present inventive concept. Accordingly, all such modifications are intended to be included within the scope of embodiments according to the present inventive concept as defined in the claims and their equivalents. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A display device comprising:

a display panel including a plurality of pixels;

a sensing data memory configured to store sensing data for threshold voltages of driving transistors of the plurality of pixels;

a controller configured to determine a total threshold voltage shift amount for the driving transistors of the plurality of pixels based on the sensing data, to determine total luminance data based on input image data, to determine a frame stress based on the total luminance data and the total threshold voltage shift amount, to determine a target compensation voltage level based on the frame stress, and to generate compensated image data by compensating the input image data based on the target compensation voltage level, wherein the controller is configured to calculate the total luminance data by summing a plurality of pixel data included in the input image data, and to calculate the frame stress by summing the total threshold voltage shift amount and the total luminance data; and a data driver configured to provide data voltages to the plurality of pixels based on the compensated image data.

2. The display device of claim 1, wherein the controller is configured to determine the target compensation voltage level such that the target compensation voltage level increases as the frame stress increases.

3. The display device of claim 1, wherein the controller is configured to:

compare the frame stress with a reference stress;

determine the target compensation voltage level as a default compensation voltage level in response to the frame stress being less than or equal to the reference stress; and increase the target compensation voltage level linearly in proportion to the frame stress as the frame stress increases in response to the frame stress being greater than the reference stress.

4. The display device of claim 1, wherein the controller is configured to:

compare the frame stress with a reference stress;

determine the target compensation voltage level as a default compensation voltage level in response to the frame stress being less than or equal to the reference stress; and increase the target compensation voltage level by using an N-th order equation of the frame stress as the frame stress increases in response to the frame stress being greater than the reference stress, where N is an integer greater than 1.

5. The display device of claim 1, wherein the controller is configured to generate a plurality of pixel compensation data based on differences between the target compensation voltage level and a plurality of threshold voltage levels corresponding to a plurality of threshold voltage data included in the sensing data, and to generate the compensated image data by adding the plurality of pixel compensation data to the input image data.

6. The display device of claim 1, wherein each of the plurality of pixels includes:

a switching transistor configured to transfer the data voltage of a data line in response to a scan signal;

a storage capacitor configured to store the data voltage transferred by the switching transistor;

the driving transistor configured to generate a driving current based on the data voltage stored in the storage capacitor;

an organic light emitting diode configured to emit light based on the driving current generated by the driving transistor; and a sensing transistor configured to connect a node between the driving transistor and the organic light emitting diode to a sensing line in response to a sensing signal.

7. The display device of claim 1, further comprising:

a sensing circuit coupled to a plurality of sensing lines, wherein the data driver is configured to, in a sensing period, provide a reference voltage to the plurality of pixels through a plurality of data lines, wherein the sensing circuit is configured to, in the sensing period, receive a plurality of sensing voltages from the plurality of pixels through the plurality of sensing lines, and to generate the sensing data corresponding to differences between the reference voltage and the plurality of sensing voltages, and wherein the controller is configured to receive the sensing data from the sensing circuit, and to write the sensing data to the sensing data memory.

8. The display device of claim 1, wherein the controller includes:

a threshold voltage shift calculating block configured to calculate current total threshold voltage data by summing a plurality of threshold voltage data included in the sensing data, and to calculate the total threshold voltage shift amount by subtracting initial total threshold voltage data before the plurality of pixels is degraded from the current total threshold voltage data;

a frame stress calculating block configured to calculate the total luminance data by summing the plurality of pixel data included in the input image data, and to calculate the frame stress by summing the total threshold voltage shift amount and the total luminance data;

a compensation target determining block configured to determine the target compensation voltage level based on the frame stress; and a data compensation block configured to generate a plurality of pixel compensation data based on differences between the target compensation voltage level and a plurality of threshold voltage levels corresponding to the plurality of threshold voltage data, and to generate the compensated image data by adding the plurality of pixel compensation data to the input image data.

9. The display device of claim 8, wherein the compensation target determining block is configured to store M frame stresses in M frame periods, where M is an integer greater than 0, to calculate an average of the M frame stresses, and to determine the target compensation voltage level according to the average of the M frame stresses.

10. The display device of claim 8, wherein, in a case where the frame stress is changed from a first frame stress to a second frame stress, the compensation target determining block is configured to gradually change the target compensation voltage level from a first target compensation voltage level corresponding to the first frame stress to a second target compensation voltage level corresponding to the second frame stress for a transition time corresponding to a plurality of frame periods.

11. The display device of claim 8, wherein the compensation target determining block is configured to receive a dimming signal representing a dimming level, and to determine the target compensation voltage level based on the frame stress and the dimming signal such that the target compensation voltage level increases as the frame stress increases and the target compensation voltage level increases as the dimming level increases.

12. The display device of claim 1, wherein the plurality of pixels includes red pixels, green pixels, and blue pixels, and wherein the controller is configured to:

determine, as the total threshold voltage shift amount, a red total threshold voltage shift amount for the red pixels, a green total threshold voltage shift amount for the green pixels, and a blue total threshold voltage shift amount for the blue pixels;

determine, as the total luminance data, red total luminance data for the red pixels, green total luminance data for the green pixels, and blue total luminance data for the blue pixels;

determine, as the frame stress, a red frame stress based on the red total luminance data and the red total threshold voltage shift amount, a green frame stress based on the green total luminance data and the green total threshold voltage shift amount, and a blue frame stress based on the blue total luminance data and the blue total threshold voltage shift amount;

determine, as the target compensation voltage level, a red target compensation voltage level corresponding to the red frame stress, a green target compensation voltage level corresponding to the green frame stress, and a blue target compensation voltage level corresponding to the blue frame stress; and generate the compensated image data by compensating the input image data based on the red target compensation voltage level, the green target compensation voltage level and the blue target compensation voltage level.

13. The display device of claim 1, wherein the display panel is divided into a plurality of pixel blocks, and wherein the controller is configured to determine, as the target compensation voltage level, a plurality of block target compensation voltage levels for the plurality of pixel blocks, and to generate the compensated image data by compensating the input image data based on the plurality of block target compensation voltage levels.

14. The display device of claim 1, wherein, in a case where the input image data are black image data representing a 0-gray level, the controller is configured to generate the compensated image data representing a negative gray level based on the target compensation voltage level that is a positive voltage level, and the data driver is configured to provide the data voltages corresponding to the compensated image data representing the negative gray level to the plurality of pixels such that the threshold voltages of the driving transistors are shifted in a negative direction.

15. A method of operating a display device including a plurality of pixels, the method comprising:

storing sensing data for threshold voltages of driving transistors of the plurality of pixels;

determining a total threshold voltage shift amount for the driving transistors of the plurality of pixels by summing a plurality of threshold voltage data included in the sensing data;

determining total luminance data based on input image data;

determining a frame stress by summing the total luminance data and the total threshold voltage shift amount;

determining a target compensation voltage level based on the frame stress;

generating compensated image data by compensating the input image data based on the target compensation voltage level; and providing data voltages to the plurality of pixels based on the compensated image data.

16. The method of claim 15, wherein determining the target compensation voltage level includes:

increasing the target compensation voltage level as the frame stress increases.

17. The method of claim 15, wherein determining the target compensation voltage level includes:

comparing the frame stress with a reference stress;

determining the target compensation voltage level as a default compensation voltage level when the frame stress is less than or equal to the reference stress; and increasing the target compensation voltage level linearly in proportion to the frame stress as the frame stress increases in response to the frame stress being greater than the reference stress.

18. The method of claim 15, wherein determining the target compensation voltage level includes:

storing M frame stresses in M frame periods, where M is an integer greater than 0;

calculating an average of the M frame stresses; and determining the target compensation voltage level according to the average of the M frame stresses.

19. The method of claim 15, wherein determining the target compensation voltage level includes:

in response to the frame stress being changed from a first frame stress to a second frame stress, gradually changing the target compensation voltage level from a first target compensation voltage level corresponding to the first frame stress to a second target compensation voltage level corresponding to the second frame stress for a transition time corresponding to a plurality of frame periods.

20. The method of claim 15, wherein determining the target compensation voltage level includes:

receiving a dimming signal representing a dimming level; and determining the target compensation voltage level based on the frame stress and the dimming signal, wherein the target compensation voltage level increases as the frame stress increases, and increases as the dimming level increases.

* * * * *